US009024517B2

(12) United States Patent
Yuan et al.

(10) Patent No.: US 9,024,517 B2
(45) Date of Patent: May 5, 2015

(54) LED LAMP WITH REMOTE PHOSPHOR AND DIFFUSER CONFIGURATION UTILIZING RED EMITTERS

(75) Inventors: Zongjie Yuan, Santa Barbara, CA (US); Eric Tarsa, Goleta, CA (US); Tao Tong, Oxnard, CA (US); Ronan Letoquin, Fremont, CA (US); Bernd Keller, Santa Barbara, CA (US); Long Larry Le, Morrisville, NC (US); James Michael Lay, Cary, NC (US); Randolph Cary Demuynck, Wake Forest, NC (US)

(73) Assignee: Cree, Inc., Durham, NC (US)

( * ) Notice: Subject to any disclaimer, the term of this patent is extended or adjusted under 35 U.S.C. 154(b) by 438 days.

(21) Appl. No.: 13/028,913

(22) Filed: Feb. 16, 2011

(65) Prior Publication Data

US 2011/0227469 A1 Sep. 22, 2011

Related U.S. Application Data

(63) Continuation-in-part of application No. 12/889,719, filed on Sep. 24, 2010, which is a continuation-in-part of application No. 12/848,825, filed on Aug. 2, 2010, now Pat. No. 8,562,161.

(Continued)

(51) Int. Cl.
*H01J 61/52* (2006.01)
*H01J 1/62* (2006.01)

(Continued)

(52) U.S. Cl.
CPC ..... *F21V 29/2231* (2013.01); *F21K 9/135* (2013.01); *F21K 9/56* (2013.01);

(Continued)

(58) Field of Classification Search
CPC ..... C09K 11/64; C09K 11/7706; C09K 11/7715; C09K 11/7721; F21K 9/00; F21K 9/50; H01L 33/50; H01L 33/20; H01L 2933/0091
USPC ..... 313/501, 512, 503, 500
See application file for complete search history.

(56) References Cited

U.S. PATENT DOCUMENTS 3,143,592 A 8/1964 August ..... 174/16.3
3,581,162 A 5/1971 Wheatley (Continued)

FOREIGN PATENT DOCUMENTS

CN 1425117 6/2003
CN 1802533 7/2006

(Continued)

OTHER PUBLICATIONS

International Search Report and Written Opinion for PCT/US2011/000400 mailed May 2, 2011.

(Continued)

*Primary Examiner* — Sikha Roy
(74) *Attorney, Agent, or Firm* — Koppel, Patrick, Heybl & Philpott

(57) ABSTRACT

Lamps and bulbs are disclosed generally comprising different combinations and arrangement of a light source, one or more wavelength conversion materials, regions or layers which are positioned separately or remotely with respect to the light source, and a separate diffusing layer. This arrangement allows for the fabrication of lamps and bulbs that are efficient, reliable and cost effective and can provide an essentially omni-directional emission pattern, even with a light source comprised of a co-planar arrangement of LEDs. Additionally, this arrangement allows aesthetic masking or concealment of the appearance of the conversion regions or layers when the lamp is not illuminated. Some embodiments of the present invention utilize LED chips to provide one or more lighting components instead of providing the components through phosphor conversion. This can provide for lamps that can be operated with lower power and can be manufactured at lower cost. In one embodiment, a red lighting component can be provided by red emitting LEDs as opposed to a red conversion material.

37 Claims, 10 Drawing Sheets

Related U.S. Application Data

(60) Provisional application No. 61/435,759, filed on Jan. 24, 2011, provisional application No. 61/435,326, filed on Jan. 23, 2011, provisional application No. 61/434,355, filed on Jan. 19, 2011, provisional application No. 61/424,670, filed on Dec. 19, 2010, provisional application No. 61/424,665, filed on Dec. 19, 2010, provisional application No. 61/386,437, filed on Sep. 24, 2010, provisional application No. 61/339,515, filed on Mar. 3, 2010, provisional application No. 61/339,516, filed on Mar. 3, 2010.

(51) Int. Cl.

| | |
|---|---|
| ***F21V 29/00*** | (2006.01) |
| ***F21K 99/00*** | (2010.01) |
| ***F21V 3/02*** | (2006.01) |
| ***F21V 3/04*** | (2006.01) |
| ***F21V 15/01*** | (2006.01) |
| ***F21V 29/02*** | (2006.01) |
| *F21V 9/16* | (2006.01) |
| *F21Y 101/02* | (2006.01) |
| *F21Y 105/00* | (2006.01) |
| *F21Y 113/00* | (2006.01) |
| *F21V 7/20* | (2006.01) |

(52) U.S. Cl.

CPC ..... *F21V 3/02* (2013.01); *F21V 3/0481* (2013.01); *F21V 29/2262* (2013.01); *F21V 15/011* (2013.01); *F21V 29/027* (2013.01); *F21V 9/16* (2013.01); *F21Y 2101/02* (2013.01); *F21Y 2105/001* (2013.01); *F21Y 2113/005* (2013.01); *F21V 29/2218* (2013.01); *F21V 7/20* (2013.01)

(56) References Cited

U.S. PATENT DOCUMENTS

| | | | | |
|---|---|---|---|---|
| 4,204,246 | A | 5/1980 | Arii et al. | 361/699 |
| 5,463,280 | A | 10/1995 | Johnson | |
| 5,561,346 | A | 10/1996 | Byrne | |
| 5,585,783 | A | 12/1996 | Hall | |
| 5,655,830 | A | 8/1997 | Ruskouski | |
| 5,688,042 | A | 11/1997 | Madadi et al. | |
| 5,806,965 | A | 9/1998 | Deese | |
| 5,890,794 | A | 4/1999 | Abtahi et al. | |
| 5,947,588 | A | 9/1999 | Huang | |
| 5,949,347 | A | 9/1999 | Wu | |
| 6,220,722 | B1 | 4/2001 | Begemann | |
| 6,227,679 | B1 | 5/2001 | Zhang et al. | |
| 6,234,648 | B1 | 5/2001 | Borner et al. | |
| 6,250,774 | B1 | 6/2001 | Begemann et al. | |
| 6,276,822 | B1 | 8/2001 | Bedrosian et al. | |
| 6,350,041 | B1 | 2/2002 | Tarsa | |
| 6,404,131 | B1 | 6/2002 | Kawano et al. | 315/82 |
| 6,465,961 | B1 | 10/2002 | Cao | |
| 6,517,221 | B1 | 2/2003 | Xie | 362/373 |
| 6,523,978 | B1 | 2/2003 | Huang | |
| 6,550,953 | B1 | 4/2003 | Ichikawa et al. | |
| 6,634,770 | B2 | 10/2003 | Cao | |
| 6,659,632 | B2 | 12/2003 | Chen | |
| 6,709,132 | B2 | 3/2004 | Ishibashi | |
| 6,803,607 | B1 | 10/2004 | Chan et al. | |
| 6,848,819 | B1 | 2/2005 | Arndt et al. | |
| 6,864,513 | B2 | 3/2005 | Lin et al. | |
| 6,910,794 | B2 | 6/2005 | Rice | 362/547 |
| 6,948,829 | B2 | 9/2005 | Verdes et al. | |
| 6,982,518 | B2 | 1/2006 | Chou et al. | |
| 7,048,412 | B2 | 5/2006 | Martin et al. | |
| 7,080,924 | B2 | 7/2006 | Tseng et al. | |
| 7,086,756 | B2 | 8/2006 | Maxik | |
| 7,086,767 | B2 | 8/2006 | Sidwell et al. | |
| 7,094,362 | B2 | 8/2006 | Setlur et al. | 252/301 |
| 7,140,753 | B2 | 11/2006 | Wang et al. | 362/294 |
| 7,144,135 | B2 | 12/2006 | Martin et al. | |
| 7,160,012 | B2 | 1/2007 | Hilscher et al. | 362/555 |
| 7,165,866 | B2 | 1/2007 | Li | |
| 7,172,314 | B2 | 2/2007 | Currie et al. | |
| 7,213,940 | B1 | 5/2007 | Van De Ven | |
| D546,980 | S | 7/2007 | Lo | |
| 7,270,446 | B2 | 9/2007 | Chang et al. | 362/294 |
| D553,267 | S | 10/2007 | Yuen | |
| 7,350,936 | B2 | 4/2008 | Ducharme et al. | 362/231 |
| 7,354,174 | B1 | 4/2008 | Yan | |
| 7,396,142 | B2 | 7/2008 | Laizure, Jr. et al. | |
| 7,405,857 | B2 | 7/2008 | Ma et al. | 359/261 |
| D581,556 | S | 11/2008 | To et al. | D26/2 |
| 7,547,124 | B2 | 6/2009 | Chang et al. | 362/373 |
| 7,549,782 | B2 | 6/2009 | Ng et al. | 362/555 |
| 7,600,882 | B1 | 10/2009 | Morejon et al. | |
| 7,614,759 | B2 | 11/2009 | Negley | |
| 7,618,157 | B1 | 11/2009 | Galvez | |
| 7,663,315 | B1 | 2/2010 | Hulse | |
| 7,686,478 | B1 | 3/2010 | Hulse | |
| 7,726,836 | B2 | 6/2010 | Chen | |
| 7,740,365 | B2 | 6/2010 | Huttner et al. | 362/97 |
| 7,753,568 | B2 | 7/2010 | Hu et al. | 362/373 |
| 7,810,954 | B2 | 10/2010 | Kolodin | 362/277 |
| 7,824,065 | B2 | 11/2010 | Maxik | |
| D629,928 | S | 12/2010 | Chen et al. | |
| 7,884,538 | B2 | 2/2011 | Mitsuishi et al. | 313/502 |
| 8,021,025 | B2 | 9/2011 | Lee | |
| 8,235,571 | B2 | 8/2012 | Park | 362/555 |
| 8,253,316 | B2 | 8/2012 | Sun et al. | |
| 8,272,762 | B2 | 9/2012 | Maxik et al. | |
| 8,274,241 | B2 | 9/2012 | Guest et al. | |
| 8,277,082 | B2 | 10/2012 | Dassanayake et al. | |
| 8,282,250 | B1 | 10/2012 | Dassanayake et al. | |
| 8,292,468 | B2 | 10/2012 | Narendran et al. | |
| 8,322,896 | B2 | 12/2012 | Falicoff et al. | |
| 8,348,470 | B2 | 1/2013 | Liu et al. | 362/294 |
| 8,371,722 | B2 | 2/2013 | Carroll | |
| 8,400,051 | B2 | 3/2013 | Hakata et al. | |
| 8,415,865 | B2 | 4/2013 | Liang et al. | |
| 8,421,320 | B2 | 4/2013 | Chuang | |
| 8,421,321 | B2 | 4/2013 | Chuang | |
| 8,421,322 | B2 | 4/2013 | Carroll et al. | |
| 8,449,154 | B2 | 5/2013 | Uemoto et al. | |
| 8,502,468 | B2 | 8/2013 | Li et al. | |
| 8,568,009 | B2 | 10/2013 | Chiang et al. | 362/563 |
| 8,641,237 | B2 | 2/2014 | Chuang | |
| 8,653,723 | B2 | 2/2014 | Cao et al. | |
| 8,696,168 | B2 | 4/2014 | Li et al. | |
| 8,740,415 | B2 | 6/2014 | Wheelock | |
| 8,750,671 | B1 | 6/2014 | Kelly et al. | |
| 8,752,984 | B2 | 6/2014 | Lenk et al. | |
| 8,760,042 | B2 | 6/2014 | Sakai et al. | |
| 2002/0047516 | A1 | 4/2002 | Iwasa et al. | 313/512 |
| 2003/0021113 | A1 | 1/2003 | Begemann | |
| 2003/0038291 | A1 | 2/2003 | Cao | |
| 2004/0159846 | A1 | 8/2004 | Doxsee | |
| 2004/0201990 | A1 | 10/2004 | Neyer | |
| 2004/0223315 | A1 | 11/2004 | Suehiro et al. | 362/84 |
| 2005/0068776 | A1 | 3/2005 | Ge | 362/296 |
| 2005/0168990 | A1 | 8/2005 | Nagata et al. | 362/294 |
| 2005/0174780 | A1 | 8/2005 | Park | 362/294 |
| 2005/0276053 | A1 | 12/2005 | Nortrup et al. | 362/294 |
| 2006/0097245 | A1 | 5/2006 | Aanegola et al. | 257/26 |
| 2006/0097385 | A1 | 5/2006 | Negley | 257/722 |
| 2006/0105482 | A1* | 5/2006 | Alferink et al. | 438/22 |
| 2006/0138435 | A1* | 6/2006 | Tarsa et al. | 257/89 |
| 2006/0152140 | A1* | 7/2006 | Brandes | 313/503 |
| 2006/0180774 | A1 | 8/2006 | Endo | 250/485.1 |
| 2006/0227558 | A1 | 10/2006 | Osawa et al. | 362/351 |
| 2007/0090737 | A1 | 4/2007 | Hu et al. | 313/11 |
| 2007/0139938 | A1 | 6/2007 | Petroski et al. | |
| 2007/0139949 | A1 | 6/2007 | Tanda et al. | 362/551 |
| 2007/0158668 | A1 | 7/2007 | Tarsa et al. | 257/98 |
| 2007/0206375 | A1 | 9/2007 | Lys | |
| 2007/0215890 | A1 | 9/2007 | Harbers et al. | 257/98 |
| 2007/0223219 | A1 | 9/2007 | Medendorp | |

(56) References Cited

U.S. PATENT DOCUMENTS

| | | | | |
|---|---|---|---|---|
| 2007/0263405 | A1 | 11/2007 | Ng et al. | 362/555 |
| 2007/0267976 | A1* | 11/2007 | Bohler et al. | 315/112 |
| 2007/0297183 | A1 | 12/2007 | Coushaine | |
| 2008/0037257 | A1 | 2/2008 | Bolta | |
| 2008/0062694 | A1 | 3/2008 | Lai et al. | 362/294 |
| 2008/0080165 | A1 | 4/2008 | Kim et al. | |
| 2008/0093615 | A1 | 4/2008 | Lin et al. | 257/98 |
| 2008/0106893 | A1* | 5/2008 | Johnson et al. | 362/228 |
| 2008/0117620 | A1 | 5/2008 | Hama et al. | 362/84 |
| 2008/0128735 | A1 | 6/2008 | Yoo et al. | |
| 2008/0149166 | A1 | 6/2008 | Beeson et al. | 136/248 |
| 2008/0173884 | A1 | 7/2008 | Chitnis et al. | 257/98 |
| 2008/0179611 | A1 | 7/2008 | Chitnis et al. | 257/98 |
| 2008/0232119 | A1 | 9/2008 | Ribarich | 362/373 |
| 2008/0285279 | A1 | 11/2008 | Ng et al. | 362/249 |
| 2008/0308825 | A1 | 12/2008 | Chakraborty et al. | 257/98 |
| 2009/0001399 | A1 | 1/2009 | Diana et al. | 257/98 |
| 2009/0015137 | A1 | 1/2009 | Su et al. | 313/503 |
| 2009/0040760 | A1 | 2/2009 | Chen et al. | 362/249 |
| 2009/0046473 | A1 | 2/2009 | Tsai et al. | 362/373 |
| 2009/0058256 | A1 | 3/2009 | Mitsuishi et al. | 313/487 |
| 2009/0059559 | A1 | 3/2009 | Pabst | |
| 2009/0086492 | A1 | 4/2009 | Meyer | |
| 2009/0095960 | A1 | 4/2009 | Murayama | 257/79 |
| 2009/0101930 | A1 | 4/2009 | Li | |
| 2009/0103293 | A1 | 4/2009 | Harbers et al. | |
| 2009/0103296 | A1 | 4/2009 | Harbers et al. | |
| 2009/0113296 | A1 | 4/2009 | Harbers et al. | |
| 2009/0116217 | A1 | 5/2009 | Teng et al. | |
| 2009/0175041 | A1 | 7/2009 | Yuen et al. | |
| 2009/0184618 | A1 | 7/2009 | Hakata et al. | |
| 2009/0195186 | A1 | 8/2009 | Guest et al. | 315/294 |
| 2009/0201679 | A1 | 8/2009 | Konaka | 362/235 |
| 2009/0217970 | A1 | 9/2009 | Zimmerman et al. | 136/252 |
| 2009/0262516 | A1 | 10/2009 | Li | 362/84 |
| 2009/0283779 | A1 | 11/2009 | Negley et al. | 257/88 |
| 2009/0316073 | A1 | 12/2009 | Chen et al. | 349/64 |
| 2009/0316383 | A1 | 12/2009 | Son | |
| 2009/0322197 | A1 | 12/2009 | Helbing | |
| 2009/0322208 | A1 | 12/2009 | Shaikevitch et al. | 313/503 |
| 2009/0322800 | A1 | 12/2009 | Atkins | 345/690 |
| 2009/0323333 | A1 | 12/2009 | Chang | |
| 2010/0014839 | A1 | 1/2010 | Benoy et al. | 386/117 |
| 2010/0020547 | A1 | 1/2010 | Olsson | 362/311 |
| 2010/0025700 | A1 | 2/2010 | Jung et al. | |
| 2010/0026185 | A1 | 2/2010 | Betsuda et al. | 315/32 |
| 2010/0038660 | A1 | 2/2010 | Shuja | 257/98 |
| 2010/0046231 | A1 | 2/2010 | Medinis | 362/294 |
| 2010/0060144 | A1* | 3/2010 | Justel et al. | 313/503 |
| 2010/0091487 | A1 | 4/2010 | Shin | 362/235 |
| 2010/0096967 | A1 | 4/2010 | Marinus et al. | 313/46 |
| 2010/0102707 | A1* | 4/2010 | Fukuda et al. | 313/503 |
| 2010/0134047 | A1 | 6/2010 | Hasnain | |
| 2010/0140655 | A1 | 6/2010 | Shi | 257/99 |
| 2010/0149783 | A1 | 6/2010 | Takenaka et al. | 362/84 |
| 2010/0170075 | A1 | 7/2010 | Kanade et al. | 29/428 |
| 2010/0177522 | A1 | 7/2010 | Lee | 362/373 |
| 2010/0201284 | A1 | 8/2010 | Kraus | |
| 2010/0207502 | A1 | 8/2010 | Cao et al. | 313/46 |
| 2010/0219735 | A1 | 9/2010 | Sakai et al. | 313/46 |
| 2010/0232134 | A1 | 9/2010 | Tran | 362/84 |
| 2010/0264799 | A1 | 10/2010 | Liu et al. | |
| 2010/0314985 | A1 | 12/2010 | Premysler | 313/46 |
| 2010/0327745 | A1 | 12/2010 | Dassanayake et al. | |
| 2010/0328925 | A1 | 12/2010 | Hoelen et al. | 362/84 |
| 2011/0037368 | A1 | 2/2011 | Huang | 313/46 |
| 2011/0074271 | A1 | 3/2011 | Takeshi et al. | 313/46 |
| 2011/0074296 | A1 | 3/2011 | Shen et al. | |
| 2011/0080096 | A1 | 4/2011 | Dudik et al. | 315/112 |
| 2011/0080740 | A1* | 4/2011 | Allen et al. | 362/294 |
| 2011/0089804 | A1 | 4/2011 | Mahalingam et al. | 313/46 |
| 2011/0089830 | A1 | 4/2011 | Pickard et al. | 315/32 |
| 2011/0095686 | A1 | 4/2011 | Falicoff et al. | 315/35 |
| 2011/0175528 | A1 | 7/2011 | Rains et al. | 315/51 |
| 2011/0176316 | A1 | 7/2011 | Phipps et al. | |
| 2011/0205733 | A1* | 8/2011 | Lenderink et al. | 362/231 |
| 2011/0216523 | A1 | 9/2011 | Tong et al. | 362/84 |
| 2011/0267835 | A1 | 11/2011 | Boonekamp et al. | 362/555 |
| 2011/0273072 | A1 | 11/2011 | Oki | 313/46 |
| 2011/0298371 | A1 | 12/2011 | Brandes et al. | 315/32 |
| 2012/0040585 | A1 | 2/2012 | Huang | |
| 2012/0155059 | A1 | 6/2012 | Hoelen et al. | 362/84 |

FOREIGN PATENT DOCUMENTS

| | | | |
|---|---|---|---|
| CN | 101262032 | | 9/2008 |
| CN | 1013388887 | A | 1/2009 |
| DE | 10251955 | A1 | 5/2004 |
| DE | 102004051382 | | 4/2006 |
| DE | 102006061164 | | 6/2008 |
| DE | 10 2007 037862 | A1 | 10/2008 |
| DE | 202008013667 | | 12/2008 |
| DE | 102011004718 | | 8/2012 |
| EP | 0876085 | | 11/1998 |
| EP | 0876085 | A2 | 11/1998 |
| EP | 0890059 | A1 | 1/1999 |
| EP | 1058221 | A2 | 12/2000 |
| EP | 1881259 | | 1/2008 |
| EP | 2146135 | A2 | 1/2010 |
| EP | 2154420 | | 2/2010 |
| EP | 2469154 | | 6/2012 |
| FR | 2941346 | | 7/2010 |
| GB | 2345954 | A | 7/2000 |
| GB | 2 366 610 | A | 3/2002 |
| GB | 2366610 | | 3/2002 |
| GB | 2366610 | A | 3/2002 |
| JP | H03081903 | | 4/1991 |
| JP | H06283006 | | 10/1994 |
| JP | H09265807 | | 10/1997 |
| JP | H11177149 | | 7/1999 |
| JP | 11-213730 | A | 8/1999 |
| JP | H11260125 | | 9/1999 |
| JP | 2000022222 | | 1/2000 |
| JP | 2000173304 | | 6/2000 |
| JP | 2001118403 | | 4/2001 |
| JP | 2003515899 | | 5/2003 |
| JP | 2004146225 | | 5/2004 |
| JP | 2004241318 | | 8/2004 |
| JP | 2005-093097 | A | 4/2005 |
| JP | 20051008700 | | 4/2005 |
| JP | 2005244226 | | 9/2005 |
| JP | 2005-286267 | A | 10/2005 |
| JP | 2005277127 | | 10/2005 |
| JP | 2005021635 | | 11/2005 |
| JP | 2006019676 | | 1/2006 |
| JP | 2006108661 | | 4/2006 |
| JP | 2006148147 | | 6/2006 |
| JP | 2006156187 | | 6/2006 |
| JP | 20066159187 | | 6/2006 |
| JP | WO2006065558 | | 6/2006 |
| JP | 200640850 | A | 9/2006 |
| JP | 2006525648 | | 11/2006 |
| JP | 2006331683 | | 12/2006 |
| JP | 200759930 | | 3/2007 |
| JP | 2007059911 | | 3/2007 |
| JP | 3138653 | | 12/2007 |
| JP | 2008505448 | | 2/2008 |
| JP | 2008091140 | | 4/2008 |
| JP | 2008108835 | | 5/2008 |
| JP | 2008187195 | | 8/2008 |
| JP | 2008262765 | | 10/2008 |
| JP | 200828183 | | 11/2008 |
| JP | 2008288409 | | 11/2008 |
| JP | 2008300117 | | 12/2008 |
| JP | 2008300203 | | 12/2008 |
| JP | 2008300570 | | 12/2008 |
| JP | 2009-016058 | A | 1/2009 |
| JP | 2009016058 | | 1/2009 |
| JP | 2009016153 | | 1/2009 |
| JP | 2009021264 | | 1/2009 |
| JP | 2009117346 | | 5/2009 |
| JP | WO2009093163 | | 7/2009 |
| JP | U3153766 | | 8/2009 |
| JP | WO2009119038 | | 10/2009 |

(56) References Cited

FOREIGN PATENT DOCUMENTS

| | | | |
|---|---|---|---|
| JP | 2009266780 | | 11/2009 |
| JP | 2009277586 | | 11/2009 |
| JP | 2009295299 | | 12/2009 |
| JP | WO2009148543 | | 12/2009 |
| JP | 201001623 | | 1/2010 |
| JP | 2010040494 | | 2/2010 |
| JP | 2010050473 | | 3/2010 |
| JP | 2010129300 | | 6/2010 |
| JP | 2010267826 | | 11/2010 |
| KR | 10094418 1 | | 2/2010 |
| KR | 1020100037353 | | 4/2010 |
| KR | 100980588 | B1 | 9/2010 |
| KR | 3020110008445 | | 3/2011 |
| TW | D134005 | | 3/2010 |
| TW | 100300960 | | 3/2011 |
| TW | D141681 | | 7/2011 |
| WO | WO 00/17569 | A1 | 3/2000 |
| WO | WO0124583 | A1 | 4/2001 |
| WO | WO 01/40702 | A1 | 6/2001 |
| WO | WO0160119 | A2 | 8/2001 |
| WO | WO2004100213 | A2 | 5/2004 |
| WO | 2004100213 | | 11/2004 |
| WO | WO2005107420 | A2 | 11/2005 |
| WO | 2006065558 | | 6/2006 |
| WO | WO 2007/130358 | A2 | 11/2007 |
| WO | WO2007146566 | A2 | 12/2007 |
| WO | 2008018002 | | 2/2008 |
| WO | WO 2008/018002 | A2 | 2/2008 |
| WO | WO2008134056 | A1 | 4/2008 |
| WO | WO 2008/052318 | A1 | 5/2008 |
| WO | WO 2008/117211 | A1 | 10/2008 |
| WO | 2008146229 | | 12/2008 |
| WO | WO 2008/146229 | A2 | 12/2008 |
| WO | WO 2009/024952 | A2 | 2/2009 |
| WO | WO2009052099 | | 4/2009 |
| WO | 2009093163 | | 7/2009 |
| WO | WO 2009/091562 | A2 | 7/2009 |
| WO | WO 2009/093163 | A2 | 7/2009 |
| WO | WO2009093163 | | 7/2009 |
| WO | WO2009093163 | A2 | 7/2009 |
| WO | 2009107052 | | 9/2009 |
| WO | WO 2009/107052 | A1 | 9/2009 |
| WO | WO2009107052 | | 9/2009 |
| WO | 2009119038 | | 10/2009 |
| WO | WO 2009/119038 | A2 | 10/2009 |
| WO | WO 2009/128004 | A1 | 10/2009 |
| WO | WO2009125314 | A2 | 10/2009 |
| WO | WO2009131627 | | 10/2009 |
| WO | WO2009143047 | A2 | 11/2009 |
| WO | WO 2009/158422 | A1 | 12/2009 |
| WO | WO2009158422 | A1 | 12/2009 |
| WO | 2010012999 | | 2/2010 |
| WO | WO 2010/012999 | A2 | 2/2010 |
| WO | WO2010013893 | | 2/2010 |
| WO | WO2010052640 | | 5/2010 |
| WO | WO 2010/119618 | A1 | 10/2010 |
| WO | WO 2010/128419 | A1 | 11/2010 |
| WO | WO2011100193 | | 8/2011 |
| WO | WO2011109091 | A1 | 9/2011 |
| WO | WO2012011279 | | 1/2012 |
| WO | WO2012031533 | | 3/2012 |

OTHER PUBLICATIONS

International Search Report and Written Opinion for PCT Application No. PCT/US2011/000399 mailed Jul. 12, 2011.
Decision to Refuse a European Patent Application for EP 09 152 962.8 dated Jul. 6, 2011.
International Search Report and Written Opinion from PCT Application No. PCT/US2012/044705 dated Oct. 9, 2012.
Notice to Submit a Response from Korean Patent Application No. 30-2011-0008446, dated Oct. 22, 2012.
International Search Report and Written Opinion for PCT Patent Application No. PCT/US2011/000405 mailed Nov. 2, 2011.
International Search Report and Written Opinion for PCT/US2011/000407 mailed Nov. 16, 2011.
Office Action of the IPO for Taiwan Patent Application No. TW 100300962 issued Nov. 21, 2011.
Office Action of the IPO for Taiwan Patent Application No. TW 100300961 issued Nov. 16, 2011.
Office Action of the IPO for Taiwan Patent Application No. TW 100300960 issued Nov. 15, 2011.
Office Action of the IPO for Taiwan Patent Application No. TW 100302770 issued Jan. 13, 2012.
Notice to Submit a Response from Korean Patent Application No. 30-2011-0008448, dated Apr. 16, 2012.
Notice to Submit a Response from Korean Patent Application No. 30-2011-0008445, dated Apr. 16, 2012.
Notice to Submit a Response from Korean Patent Application No. 30-2011-0008446, dated Apr. 16, 2012.
Office Action for Taiwanese Patent Application No. 100300961, dated May 7, 2012.
Office Action from Taiwanese Patent Application No. 100300960. dated May 7, 2012.
International Search Report and Written Opinion, PCT/US2009/063804, Mailed on Feb. 26, 2010.
U.S. Appl. No. 12/566,195, Van De Ven, filed Sep. 24, 2009.
U.S. Appl. No. 12/704,730, Van De Ven, filed Feb. 12, 2010.
C. Crane Geobulb®-II LED Light Bulb, Item #2SW, Description, p. 1-2.
Cree LR6, 6" Recessed Downlight Module, Product Info, p. 1-2.
U.S. Appl. No. 12/901,405, filed Oct. 8, 2010, Tong.
U.S. Appl. No. 61/339,515, filed Mar. 3, 2010, Tong.
U.S. Appl. No. 12/848,825, filed Aug. 2, 2010, Tong.
U.S. Appl. No. 12/975,820, Van De Ven.
U.S. Appl. No. 13/029,063, filed Feb. 16, 2011, Hussell.
US Publication No. 2005/0242711 AI, Date Nov. 3, 2005 Bloomfield.
US Publication No. 2002/0047516 A1, Date Apr. 25, 2002 Iwasa.
US Publication No. 2007/0263405 A1, Date Nov. 15, 2007 Ng.
U.S. Appl. No. 61/424,670, filed Dec. 19, 2010, Zongjie Yuan.
U.S. Appl. No. 11/656,759, filed Jan. 22, 2007 Chitnis.
U.S. Appl. No. 11/899,790, filed Sep. 7, 2007 Chitnis.
U.S. Appl. No. 11/473,089, filed date Jun. 21, 2006 Tarsa.
U.S. Appl. No. 61/435,759, filed date Jan. 24, 2011 Le.
U.S. Appl. No. 61/339,516, filed date Mar. 3, 2010 Tong.
US Publication No. 2010/0155763, Filing Date Jun. 24, 2010 Donofrio.
International Search Report and Written Opinion for PCT/US2011/000403 mailed Aug. 23, 2011.
International Search Report and Written Opinion for PCT/US2011/000404 mailed Aug. 25, 2011.
International Search Report and Written Opinion for PCT/US2011/000398 mailed Aug. 30, 2011.
International Search Report and Written Opinion for counterpart PCT/US2011/000406 mailed Sep. 15, 2011.
Notice to Submit a Response from Korean Design Patent Application No. 30-2011-0024961. dated Sep. 10, 2012.
International Search Report and Written Opinion for PCT Application No. PCT/US2011/000391 mailed Oct. 6, 2011.
International Search Report and Written Opinion for PCT Application No. PCT/US2011/000402 mailed Sep. 30, 2011.
International Search Report and Written Opinion for PCT Application No. PCT/US2011/000397 mailed May 24, 2011.
International Search Report and Written Opinion for PCT Application No. PCT/US2010/003146 mailed Jun. 7, 2011.
Decision for Final Rejection for Japanese Patent Application No. 2001-542133 mailed Jun. 28, 2011.
Office Action from U.S. Appl. No. 13/028,946, dated Jul. 16, 2012.
Response to OA from U.S. Appl. No. 13/628,946, filed Oct. 8, 2012.
Office Action from U.S. Appl. No. 13/029,025, dated Jul. 16, 2013.
Office Action from U.S. Appl. No. 13/430,478, dated Jun. 18, 2013.
Office Action from U.S. Appl. No. 12/901,405, dated Jul. 1, 2013.
Office Action from U.S. Appl. No. 13/015,291, dated Oct. 10, 2012.
Response to OA from U.S. Appl. No. 13/018,291, filed Jan. 7, 2013.
Office Action from U.S. Appl. No. 13/022,490, dated Nov. 7, 2012.
Response to OA from U.S. Appl. No. 13/022,490, filed Feb. 1, 2013.
Office Action from U.S. Appl. No. 13/034,501, dated Dec. 3, 2012.

(56) References Cited

OTHER PUBLICATIONS

Response to OA from U.S. Appl. No. 13/034,501, filed Apr. 3, 2013.
Office Action from U.S. Appl. No, 13/028,946, dated Dec. 4, 2012.
Response to OA from U.S. Appl. No. 13/028,946, filed Jan. 29, 2013.
Office Action from U.S. Appl. No. 13/029,005. dated Jan. 24, 2013.
Office Action from U.S. Appl. No. 12/901,405, dated Jan. 9, 2013.
Response to OA from U.S. Appl. No. 12/901,405, filed Apr. 29, 2013.
Office Action from U.S. Appl. No. 12/985,275, dated Feb. 28, 2013.
Response to OA from U.S. Appl. No. 12/985,275, filed May 28, 2013.
Office Action from U.S. Appl. No. 13/018,291, dated Mar. 20, 2013.
Response to OA from U.S. Appl. No. 13/018,291, filed May 20, 2013.
Office Action from U.S. Appl. No. 13/022,490, dated Apr. 2, 2013.
Office Action from U.S. Appl. No. 13/018,291, dated May 31, 2013.
Office Action from U.S. Appl. No. 12/636,958, dated Jul. 19, 2012.
Response to OA from U.S. Appl. No. 12/636,958, filed Nov. 19, 2012.
Office Action from U.S. Appl. No. 13/054,501, dated May 31, 2013.
Office Action from U.S. Appl. No. 13/028,946, filed Apr. 11, 2013.
Office Action from U.S. Appl. No. 13/029,005. dated Jan. 4, 2013.
Response to OA from U.S. Appl. No. 13/029,005, filed Apr. 17, 2013.
Office Action from U.S. Appl. No. 12/848,825, dated Nov. 5, 2012.
Response to OA from U.S. Appl. No. 12/848,825, filed Feb. 5, 2013.
Office Action from U.S. Appl. No. 13/029,005, dated Jun. 11, 2013.
Search Report and Written Opinion from PCT Application No. PCT/US2012/072108. dated Feb. 27, 2013.
International Search Report and Written Opinion from PCT Application No. PCT/US2011/000389, dated May 6, 2013.
International Search Report and Written Opinion from PCT Application No. PCT/US2011/000390, dated May 6, 2013.
International Preliminary Report on Patentability from PCT/US2011/00389, dated May 8, 2013.
International Preliminary Report on Patentability from PCT/US2011/000390, dated May 8, 2013.
Reasons for Rejection from Japanese Patent Appl. No. 2011-198454, dated Mar. 7, 2013.
Notice of Reasons for Rejection from Japanese Patent Appl. No. 2012-543086, dated Aug. 27, 2013.
Decision of Dismissal of Amendment, Decision of Rejection from Japanese Patent Appl. No. 2511-231319, dated Oct. 15, 2013.
Office Action from Japanese Patent Appl. No. 2012-556063, dated Oct. 11, 2013.
Office Action from Japanese Patent Appl. No. 2012-556066, dated Oct. 25, 2013.
Office Action from Japanese Patent Appl. No. 2012-556065, dated Oct. 25, 2013.
Office Action from Japanese Patent Appl. No. 2012-556064, dated Oct. 29, 2013.
Office Action from U.S. Appl. No. 13/029,063, dated Oct. 23, 2013.
Office Action from U.S. Appl. No. 13/028,946, dated Oct. 31, 2013.
Office Action from U.S. Appl. No. 13/029,068, dated Nov. 15, 2013.
Office Action from U.S. Appl. No. 13/029,025, dated Dec. 6, 2013.
First Office Action from Chinese Patent Appl. No. 201080062056. X, dated Feb. 12, 2014.
Office Action from U.S. Appl. No. 13/028,863, dated Mar. 4, 2014.
Office Action from U.S. Appl. No. 13/430,478, dated Feb. 21, 2014.
Office Action from U.S. Appl. No. 13/358,901, dated Mar. 6, 2014.
Office Action from U.S. Appl. No. 13/018,291, dated Mar. 7, 2014.
Office Action from U.S. Appl. No. 13/029,025, dated Mar. 19, 2014.
Office Action from Japanese Patent appl. No. 2012-556063, dated Jan. 28, 2014.
Comments on the Written Opinion and Amendment of the Application from European Patent appl. No. 12740244.4, dated Feb. 20, 2014.
International Search Report and Written Opinion from PCT/US2013/057712 dated Feb. 4, 2014.
Office Action from U.S. Appl. No. 11/149,999, dated Jan. 15, 2014.
Office Action from U.S. Appl. No. 13/034,501, dated Jan. 23, 2014.
Office Action from U.S. Appl. No. 13/029,063, dated Apr. 1, 2014.
Office Action from U.S. Appl. No. 12/985,275, dated Apr. 10, 2014.
Office Action from U.S. Appl. No. 13/029,068, dated Apr. 24, 2014.
Office Action from U.S. Appl. No. 13/034,501, dated May 5, 2014.
Office Action from U.S. Appl. No. 13/022,490, dated May 6, 2014.
Office Action from U.S. Appl. No. 13/028,863, dated May 9, 2014.
Office Action from Japanese Patent Appl. No. 2012-556066. dated Mar. 14, 2014.
First Office Action from Chinese Patent Application No. 2011800207069, dated May 5, 2014.
First Office Action from Chinese Patent Application No. 201180022606, dated May 4, 2014.
First Office Action from Chinese Patent Appl. No. 201180020709.2, dated May 4, 2014.
Office Action from U.S. Appl. No. 12/028,946, dated May 27, 2014.
Decision to Grant from Japanese Patent Appl. No. 2012-556066, dated Jul. 4, 2014.
Decision of Rejection from Japanese Patent Appl. No. 2012-556064, dated Jun. 6, 2014.
Office Action from U.S. Appl. No. 13/029,068, dated Jun. 13, 2014.
Office Action from U.S. Appl. No. 13/018,245, dated Jun. 10, 2014.
First Office Action and Search Report from Chinese Patent Appl. No. 201180022620X, dated Jul. 1, 2014.
Notice of Reasons for Rejection from Japanese Patent Appl. No. 2012-543086, dated Dec. 24, 2013.
Office Action from Japanese Patent Appl. No. 2012-556062. dated Dec. 20, 2013.
International Preliminary Report on Patentability and Written Opinion from PCT/US2012/044705 dated Jan. 7, 2014.
First Office Action from Chinese Patent Appl. No. 2011800223856, dated Aug. 1, 2014.
First Office Action from Chinese Patent Appl. No. 2011800226248. dated Aug. 25, 2014.
Official Action from European Patent Appl. No. 11710348.1-1757, dated Oct. 9, 2014.
Office Action from Japanese Patent Appl. No. 2012-556065, dated Aug. 5, 2014.
Office Action from Japanese Patent Appl. No. 2012-556062, dated Aug. 5, 2014.
First Office Action from Chinese Patent Appl. No. 2011800223837, dated Jul. 24, 2014.
Office Action from European Patent Appl. No. 11710906.6-1757, dated Sep. 10, 2014.
Office Action from U.S. Appl. No. 13/358,901, dated Jul. 15, 2014.
Response to OA from U.S. Appl. No. 13/358,901, filed Aug. 21, 2014.
Office Action from U.S. Appl. No. 13/340,478, dated Jul. 23, 2014.
Office Action from U.S. Appl. No. 14/014,272, dated Jul. 29, 2014.
Office Action from U.S. Appl. No. 13/029,025, dated Aug. 6, 2014.
Office Action from U.S. Appl. No. 12/985,275, dated Aug. 7, 2014.
Office Action from U.S. Appl. No. 12/901,405, dated Aug. 7, 2014.

* cited by examiner

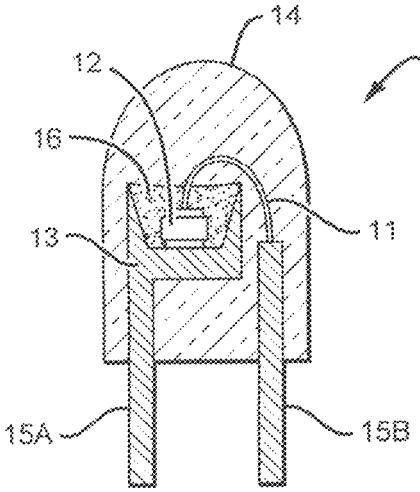
FIG. 1
PRIOR ART
FIG. 2
PRIOR ART
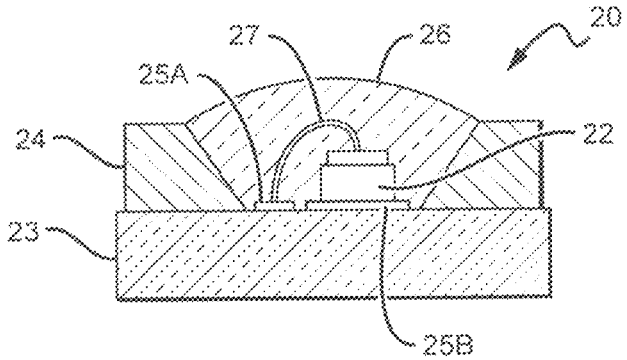
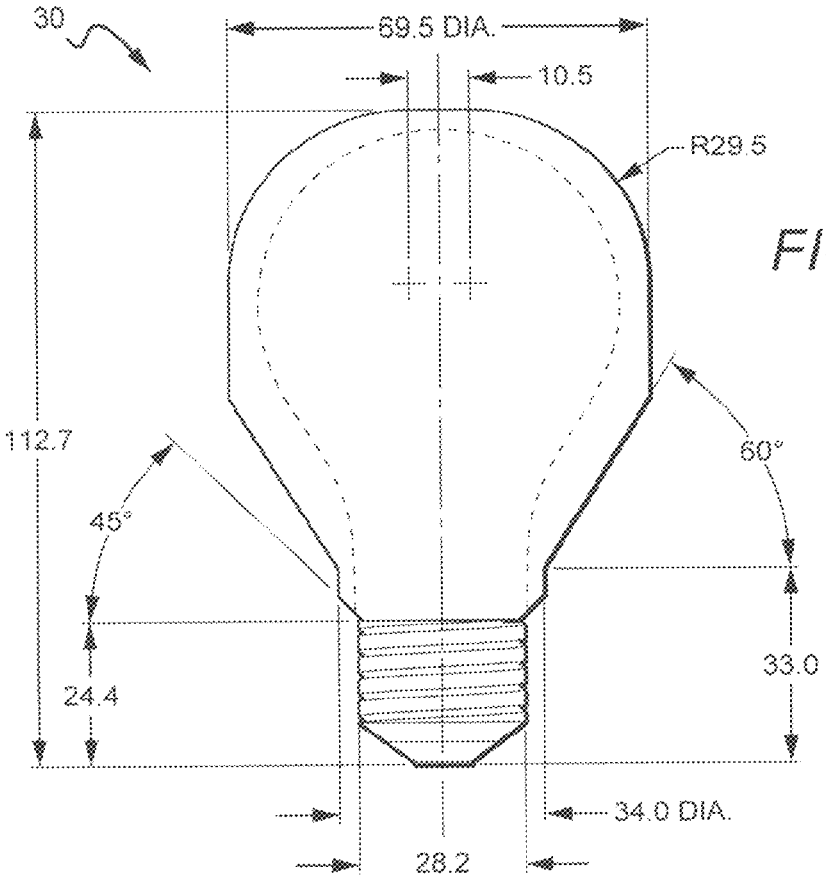
FIG. 3

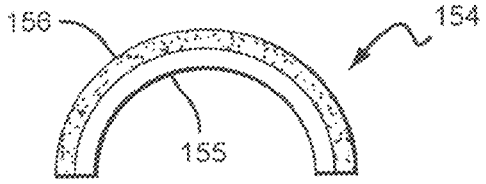
FIG. 7
FIG. 8
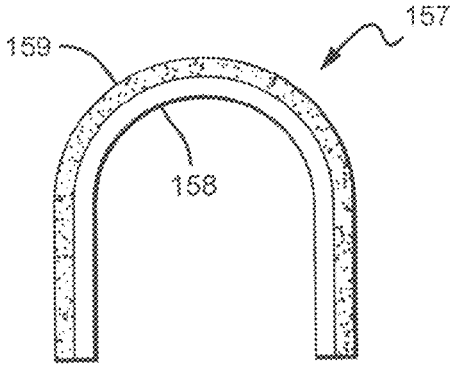
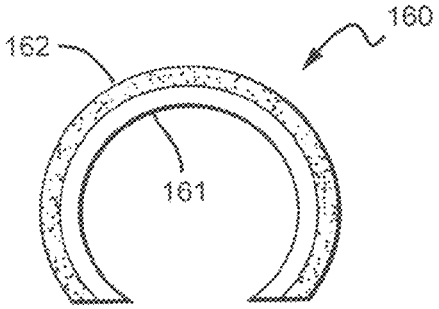
FIG. 9
FIG. 10
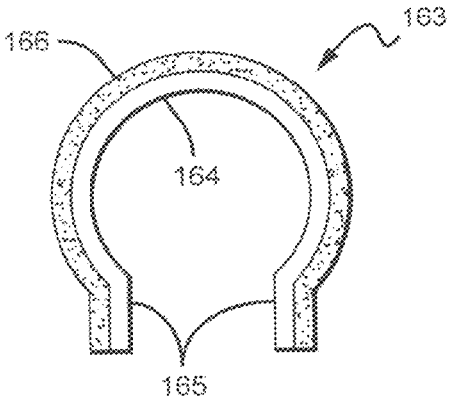
FIG. 11
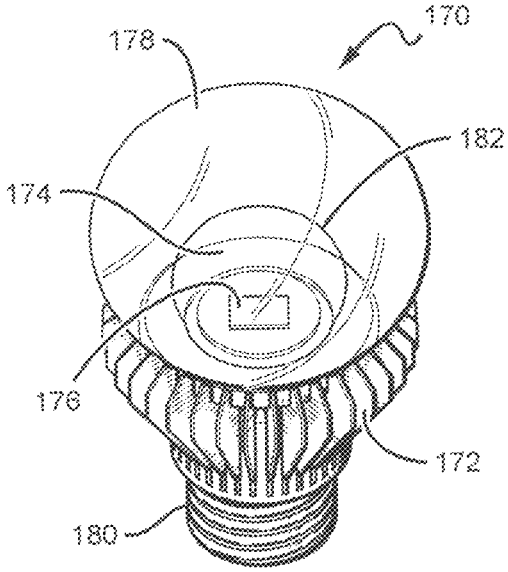
FIG. 12
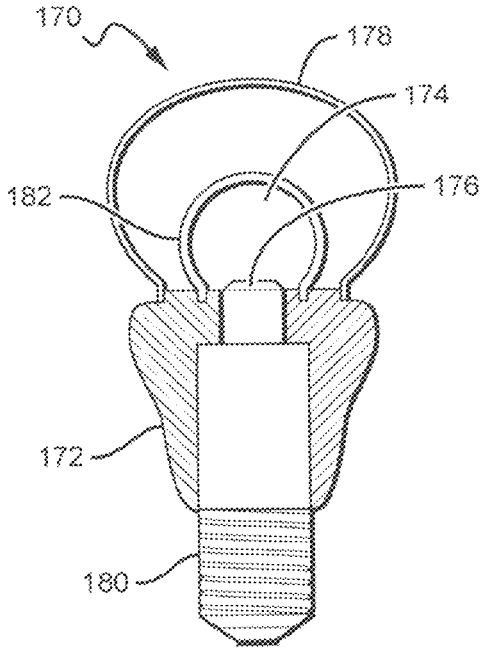

FIG. 17
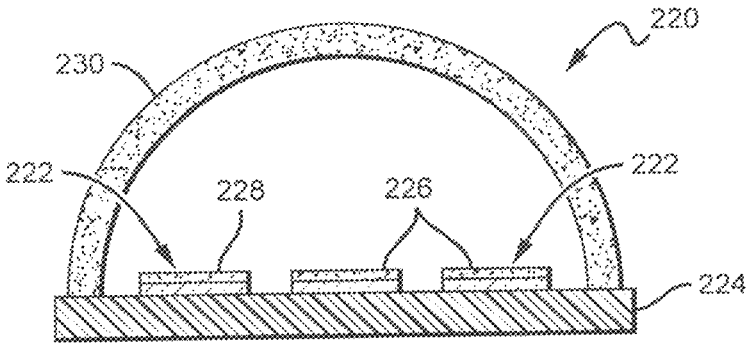
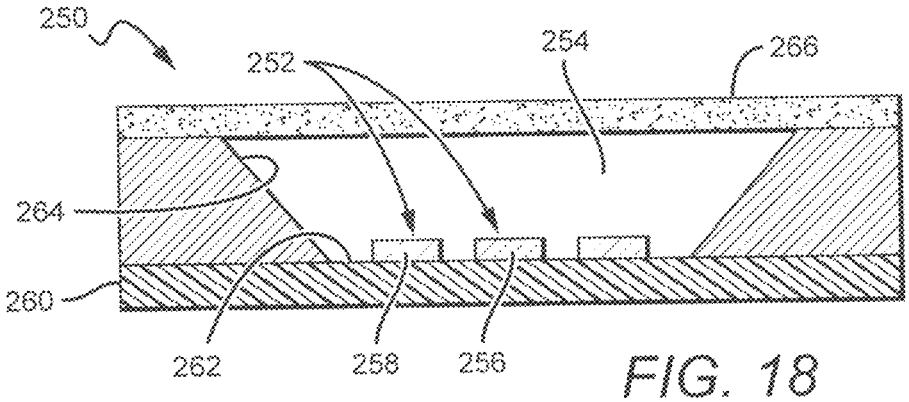
FIG. 18
FIG. 19
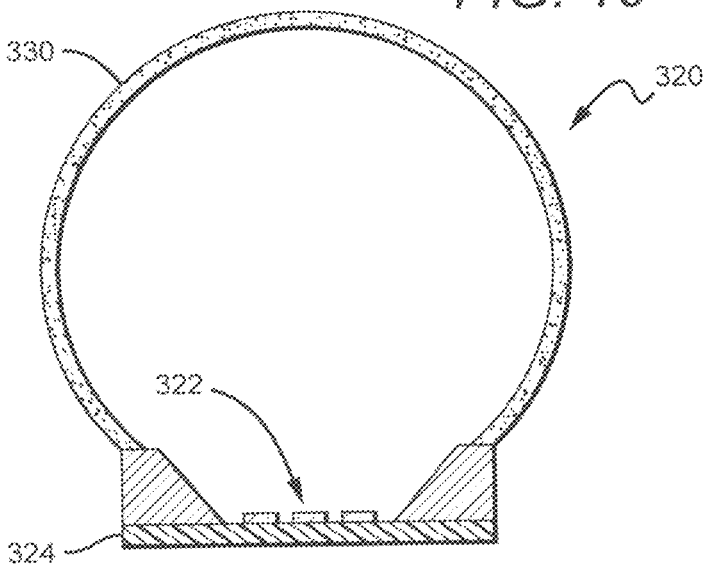

| INSTANT ON | CURRENT BLUE | CURRENT RED | WATT (DC) | LF (lm) | CCT (K) | CRI | LPW |
|---|---|---|---|---|---|---|---|
| BG301 | 300mA | 480mA | 7.75 W | 835 | 3087 | 73.6 | 107 |
| NYAG | 400mA | 250mA | 7.85 W | 890 | 3023 | 83.2 | 113 |

LED LAMP WITH REMOTE PHOSPHOR AND DIFFUSER CONFIGURATION UTILIZING RED EMITTERS

This application claims the benefit of U.S. Provisional Patent Application Ser. No. 61/339,516, filed on Mar. 3, 2010, U.S. Provisional Patent Application Ser. No. 61/339,515, filed on Mar. 3, 2010, U.S. Provisional Patent Application Ser. No. 61/386,437, filed on Sep. 24, 2010, U.S. Provisional Application Ser. No. 61/424,665, filed on Dec. 19, 2010, U.S. Provisional Application Ser. No. 61/424,670, filed on Dec. 19, 2010, U.S. Provisional Patent Application Ser. No. 61/434,355, filed on Jan. 19, 2011, U.S. Provisional Patent Application Ser. No. 61/435,326, filed on Jan. 23, 2011, U.S. Provisional Patent Application Ser. No. 61/435,759, filed on Jan. 24, 2011. This application is also a continuation-in-part from, and claims the benefit of, U.S. patent application Ser. No. 12/848,825, filed on Aug. 2, 2010, and U.S. patent application Ser. No. 12/889,719, filed on Sep. 24, 2010.

BACKGROUND OF THE INVENTION

1. Field of the Invention

This invention relates to solid state lamps and bulbs and in particular to efficient and reliable light emitting diode (LED) based lamps and bulbs capable of producing omnidirectional emission patterns.

2. Description of the Related Art

Incandescent or filament-based lamps or bulbs are commonly used as light sources for both residential and commercial facilities. However, such lamps are highly inefficient light sources, with as much as 95% of the input energy lost, primarily in the form of heat or infrared energy. One common alternative to incandescent lamps, so-called compact fluorescent lamps (CFLs), are more effective at converting electricity into light but require the use of toxic materials which, along with its various compounds, can cause both chronic and acute poisoning and can lead to environmental pollution. One solution for improving the efficiency of lamps or bulbs is to use solid state devices such as light emitting diodes (LED or LEDs), rather than metal filaments, to produce light.

Light emitting diodes generally comprise one or more active layers of semiconductor material sandwiched between oppositely doped layers. When a bias is applied across the doped layers, holes and electrons are injected into the active layer where they recombine to generate light. Light is emitted from the active layer and from various surfaces of the LED.

In order to use an LED chip in a circuit or other like arrangement, it is known to enclose an LED chip in a package to provide environmental and/or mechanical protection, color selection, light focusing and the like. An LED package also includes electrical leads, contacts or traces for electrically connecting the LED package to an external circuit. In a typical LED package 10 illustrated in FIG. 1, a single LED chip 12 is mounted on a reflective cup 13 by means of a solder bond or conductive epoxy. One or more wire bonds 11 connect the ohmic contacts of the LED chip 12 to leads 15A and/or 15B, which may be attached to or integral with the reflective cup 13. The reflective cup may be filled with an encapsulant material 16 which may contain a wavelength conversion material such as a phosphor. Light emitted by the LED at a first wavelength may be absorbed by the phosphor, which may responsively emit light at a second wavelength. The entire assembly is then encapsulated in a clear protective resin 14, which may be molded in the shape of a lens to collimate the light emitted from the LED chip 12. While the reflective cup 13 may direct light in an upward direction, optical losses may occur when the light is reflected (i.e. some light may be absorbed by the reflective cup due to the less than 100% reflectivity of practical reflector surfaces). In addition, heat retention may be an issue for a package such as the package 10 shown in FIG. 1, since it may be difficult to extract heat through the leads 15A, 15B.

A conventional LED package 20 illustrated in FIG. 2 may be more suited for high power operations which may generate more heat. In the LED package 20, one or more LED chips 22 are mounted onto a carrier such as a printed circuit board (PCB) carrier, substrate or submount 23. A metal reflector 24 mounted on the submount 23 surrounds the LED chip(s) 22 and reflects light emitted by the LED chips 22 away from the package 20. The reflector 24 also provides mechanical protection to the LED chips 22. One or more wirebond connections 27 are made between ohmic contacts on the LED chips 22 and electrical traces 25A, 25B on the submount 23. The mounted LED chips 22 are then covered with an encapsulant 26, which may provide environmental and mechanical protection to the chips while also acting as a lens. The metal reflector 24 is typically attached to the carrier by means of a solder or epoxy bond.

LED chips, such as those found in the LED package 20 of FIG. 2 can be coated by conversion material comprising one or more phosphors, with the phosphors absorbing at least some of the LED light. The LED chip can emit a different wavelength of light such that it emits a combination of light from the LED and the phosphor. The LED chip(s) can be coated with a phosphor using many different methods, with one suitable method being described in U.S. patent application Ser. Nos. 11/656,759 and 11/899,790, both to Chitnis et al. and both entitled "Wafer Level Phosphor Coating Method and Devices Fabricated Utilizing Method". Alternatively, the LEDs can be coated using other methods such as electrophoretic deposition (EPD), with a suitable EPD method described in U.S. patent application Ser. No. 11/473,089 to Tarsa et al. entitled "Close Loop Electrophoretic Deposition of Semiconductor Devices".

LED chips which have a conversion material in close proximity or as a direct coating have been used in a variety of different packages, but experience some limitations based on the structure of the devices. When the phosphor material is on or in close proximity to the LED epitaxial layers (and in some instances comprises a conformal coat over the LED), the phosphor can be subjected directly to heat generated by the chip which can cause the temperature of the phosphor material to increase. Further, in such cases the phosphor can be subjected to very high concentrations or flux of incident light from the LED. Since the conversion process is in general not 100% efficient, excess heat is produced in the phosphor layer in proportion to the incident light flux. In compact phosphor layers close to the LED chip, this can lead to substantial temperature increases in the phosphor layer as large quantities of heat are generated in small areas. This temperature increase can be exacerbated when phosphor particles are embedded in low thermal conductivity material such as silicone which does not provide an effective dissipation path for the heat generated within the phosphor particles. Such elevated operating temperatures can cause degradation of the phosphor and surrounding materials over time, as well as a reduction in phosphor conversion efficiency and a shift in conversion color.

Lamps have also been developed utilizing solid state light sources, such as LEDs, in combination with a conversion material that is separated from or remote to the LEDs. Such arrangements are disclosed in U.S. Pat. No. 6,350,041 to Tarsa et al., entitled "High Output Radial Dispersing Lamp Using a Solid State Light Source." The lamps described in this patent can comprise a solid state light source that transmits light through a separator to a disperser having a phosphor. The disperser can disperse the light in a desired pattern and/or changes its color by converting at least some of the light to a different wavelength through a phosphor or other conversion material. In some embodiments the separator spaces the light source a sufficient distance from the disperser such that heat from the light source will not transfer to the disperser when the light source is carrying elevated currents necessary for room illumination. Additional remote phosphor techniques are described in U.S. Pat. No. 7,614,759 to Negley et al., entitled "Lighting Device."

One potential disadvantage of lamps incorporating remote phosphors is that they can have undesirable visual or aesthetic characteristics. When the lamps are not generating light the lamp can have a surface color that is different from the typical white or clear appearance of the standard Edison bulb. In some instances the lamp can have a yellow or orange appearance, primarily resulting from the phosphor conversion material, such as yellow/green and red phosphors. This appearance can be considered undesirable for many applications where it can cause aesthetic issues with the surrounding architectural elements when the light is not illuminated. This can have a negative impact on the overall consumer acceptance of these types of lamps.

Further, compared to conformal or adjacent phosphor arrangements where heat generated in the phosphor layer during the conversion process may be conducted or dissipated via the nearby chip or substrate surfaces, remote phosphor arrangements can be subject to inadequate thermally conductive heat dissipation paths. Without an effective heat dissipation pathway, thermally isolated remote phosphors may suffer from elevated operating temperatures that in some instances can be even higher than the temperature in comparable conformal coated layers. This can offset some or all of the benefit achieved by placing the phosphor remotely with respect to the chip. Stated differently, remote phosphor placement relative to the LED chip can reduce or eliminate direct heating of the phosphor layer due to heat generated within the LED chip during operation, but the resulting phosphor temperature decrease may be offset in part or entirely due to heat generated in the phosphor layer itself during the light conversion process and lack of a suitable thermal path to dissipate this generated heat.

Another issue affecting the implementation and acceptance of lamps utilizing solid state light sources relates to the nature of the light emitted by the light source itself. In order to fabricate efficient lamps or bulbs based on LED light sources (and associated conversion layers), it is typically desirable to place the LED chips or packages in a co-planar arrangement. This facilitates manufacture and can reduce manufacturing costs by allowing the use of conventional production equipment and processes. However, co-planar arrangements of LED chips typically produce a forward directed light intensity profile (e.g., a Lambertian profile). Such beam profiles are generally not desired in applications where the solid-state lamp or bulb is intended to replace a conventional lamp such as a traditional incandescent bulb, which has a much more omni-directional beam pattern. While it is possible to mount the LED light sources or packages in a three-dimensional arrangement, such arrangements are generally difficult and expensive to fabricate.

SUMMARY OF THE INVENTION

The present invention provides lamps and bulbs generally comprising different combinations and arrangement of a light source, one or more wavelength conversion materials, regions or layers which are positioned separately or remotely with respect to the light source, and a separate diffusing layer. This arrangement allows for the fabrication of lamps and bulbs that are efficient, reliable and cost effective and can provide an essentially omni-directional emission pattern, even with a light source comprised of a co-planar arrangement of LEDs. Additionally, this arrangement allows aesthetic masking or concealment of the appearance of the conversion regions or layers when the lamp is not illuminated. Some embodiments of the present invention utilize LED chips to provide one or more lighting components instead of providing the components through phosphor conversion. This can provide for lamps that can be operated with lower power and can be manufactured at lower cost. In one embodiment, a red lighting component can be provided by red emitting LEDs as opposed to a red conversion material.

One embodiment of a solid state lamp according to the present invention comprises a first LED emitting light at a first peak emission and a second LED emitting light at a second respective peak emission. A conversion material is provided that is spaced from the first and second LEDs with light from the first and second LEDs passing through the conversion material. The conversion material absorbs at least some of the light from the second LED and re-emits light at a third respective peak emission. The lamp emitting a combination of light from the first, second and third peak emissions.

Another embodiment of a solid state lamp according to the present inventions comprises a heat sink and an array of LEDs mounted to the heat sink. The array of LEDs provides light with first and second respective peak wavelengths. A conversion material is included that is mounted to the heat sink, over and remote to the array of LEDs. Light from the LEDs passing through the conversion material, with the conversion material absorbing a portion of one of the first and second peak wavelengths and re-emitting a respective third peak wavelength. The lamp emits light comprising a combination of the first, second and third peak wavelengths.

Still another embodiment of a solid state lamp according to the present invention comprises a blue emitting LED and a red emitting LED. A phosphor is included over and spaced from the blue and red LEDs, with light from the blue and red LEDs passing through the phosphor. The phosphor absorbs at least some of the blue LED light and re-emitting a respective wavelength of light. The lamp emitting a white light combination of red, blue and re-emitted phosphor light.

These and other aspects and advantages of the invention will become apparent from the following detailed description and the accompanying drawings which illustrate by way of example the features of the invention.

BRIEF DESCRIPTION OF THE DRAWINGS

FIG. 1 shows a sectional view of one embodiment of a prior art LED lamp;

FIG. 2 shows a sectional view of another embodiment of a prior art LED lamp;

FIG. 3 shows the size specifications for an A19 replacement bulb;

FIG. 7-10 are sectional views of different embodiments of a phosphor carrier according to the present invention;

FIG. 11 is a perspective view of one embodiment of a lamp according to the present invention;

FIG. 12 is a sectional view of the lamp shown in FIG. 11;

FIG. 17 is a sectional view of one embodiment of a lamp according to the present invention;

FIG. 18 is a sectional view of one embodiment of a lamp according to the present invention;

FIG. 19 is a sectional view of one embodiment of a lamp according to the present invention;

DETAILED DESCRIPTION OF THE INVENTION

Figure 4:
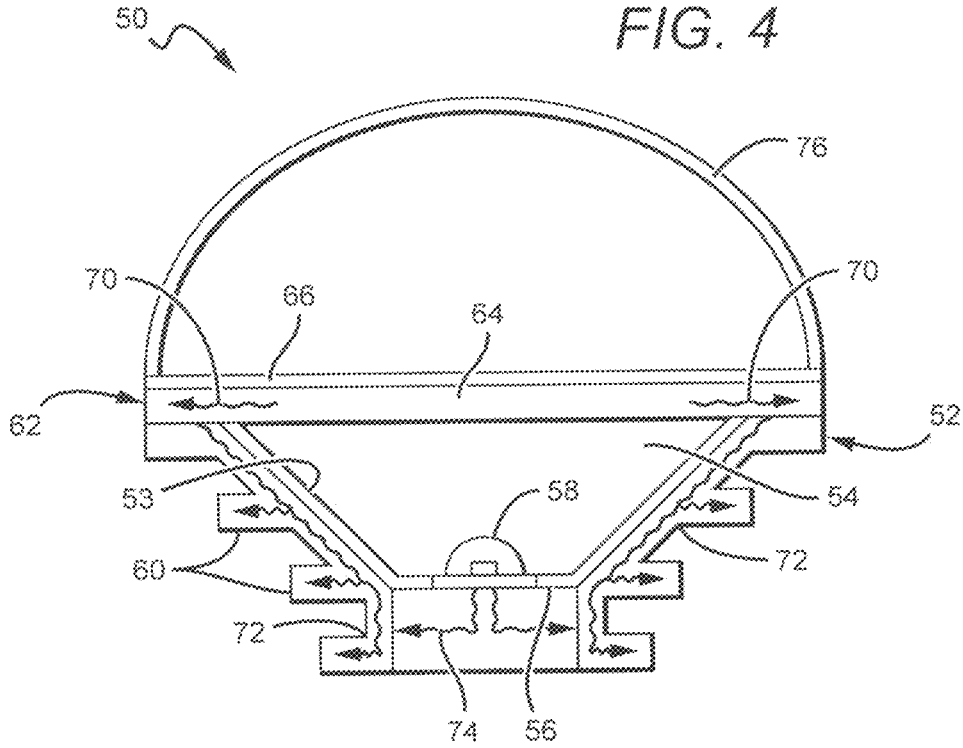
FIG. 4 is a sectional view of one embodiment of a lamp according to the present invention.

The present invention is directed to different embodiments of lamp or bulb structures that are efficient, reliable and cost effective, and that in some embodiments can provide an essentially omnidirectional emission pattern from directional emitting light sources, such as forward emitting light sources. The present invention is also directed to lamp structures using solid state emitters with remote conversion materials (or phosphors) and remote diffusing elements or diffuser. In some embodiments, the diffuser not only serves to mask the phosphor from the view by the lamp user, but can also disperse or redistribute the light from the remote phosphor and/or the lamp's light source into a desired emission pattern. In some embodiments the diffuser dome can be arranged to disperse forward directed emission pattern into a more omnidirectional pattern useful for general lighting applications. The diffuser can be used in embodiments having two-dimensional as well as three-dimensional shaped remote conversion materials, with a combination of features capable of transforming forward directed emission from an LED light source into a beam profile comparable with standard incandescent bulbs.

The present invention is described herein with reference to conversion materials, wavelength conversion materials, remote phosphors, phosphors, phosphor layers and related terms. The use of these terms should not be construed as limiting. It is understood that the use of the term remote phosphors, phosphor or phosphor layers is meant to encompass and be equally applicable to all wavelength conversion materials.

Some embodiments of lamps can have a dome-shaped (or frusto-spherical shaped) three dimensional conversion material over and spaced apart from the light source, and a dome-shaped diffuser spaced apart from and over the conversion material, such that the lamp exhibits a double-dome structure. The spaces between the various structure can comprise light mixing chambers that can promote not only dispersion of, but also color uniformity of the lamp emission. The space between the light source and conversion material, as well as the space between the conversion material, can serve as light mixing chambers. Other embodiments can comprise additional conversion materials or diffusers that can form additional mixing chambers. The order of the dome conversion materials and dome shaped diffusers can be different such that some embodiments can have a diffuser inside a conversion material, with the spaces between forming light mixing chambers. These are only a few of the many different conversion materials and diffuser arrangements according to the present invention.

Some lamp embodiments according to the present invention can comprise a light source having a co-planar arrangement of one or more LED chips or packages, with the emitters being mounted on a flat or planar surface. In other embodiments, the LED chips can be non co-planar, such as being on a pedestal or other three-dimensional structure. Co-planar light sources can reduce the complexity of the emitter arrangement, making them both easier and cheaper to manufacture. Co-planar light sources, however, tend to emit primarily in the forward direction such as in a Lambertian emission pattern. In different embodiments it can be desirable to emit a light pattern mimicking that of conventional incandescent light bulbs that can provide a nearly uniform emission intensity and color uniformity at different emission angles. Different embodiments of the present invention can comprise features that can transform the emission pattern from the non-uniform to substantially uniform within a range of viewing angles.

In some embodiments, a conversion layer or region can comprise a phosphor carrier that can comprise a thermally conductive material that is at least partially transparent to light from the light source, and at least one phosphor material each of which absorbs light from the light source and emits a different wavelength of light. The diffuser can comprise a scattering film/particles and associated carrier such as a glass enclosure, and can serve to scatter or re-direct at least some of the light emitted by the light source and/or phosphor carrier to provide a desired beam profile. In some embodiments the lamps according to the present invention can emit a beam profile compatible with standard incandescent bulbs.

The properties of the diffuser, such as geometry, scattering properties of the scattering layer, surface roughness or smoothness, and spatial distribution of the scattering layer properties may be used to control various lamp properties such as color uniformity and light intensity distribution as a function of viewing angle. By masking the phosphor carrier and other internal lamp features the diffuser provides a desired overall lamp appearance when the lamp or bulb is not illuminated.

A heat sink structure can be included which can be in thermal contact with the light source and with the phosphor carrier in order to dissipate heat generated within the light source and phosphor layer into the surrounding ambient. Electronic circuits may also be included to provide electrical power to the light source and other capabilities such as dimming, etc., and the circuits may include a means by which to apply power to the lamp, such as an Edison socket, etc.

Different embodiments of the lamps can have many different shapes and sizes, with some embodiments having dimensions to fit into standard size envelopes, such as the A19 size envelope 30 as shown in FIG. 3. This makes the lamps particularly useful as replacements for conventional incandescent and fluorescent lamps or bulbs, with lamps according to the present invention experiencing the reduced energy consumption and long life provided from their solid state light sources. The lamps according to the present invention can also fit other types of standard size profiles including but not limited to A21 and A23.

In some embodiments the light sources can comprise solid state light sources, such as different types of LEDs, LED chips or LED packages. In some embodiments a single LED chip or package can be used, while in others multiple LED chips or packages can be arranged in different types of arrays. By having the phosphor thermally isolated from LED chips and with good thermal dissipation, the LED chips can be driven by higher current levels without causing detrimental effects to the conversion efficiency of the phosphor and its long term reliability. This can allow for the flexibility to overdrive the LED chips to lower the number of LEDs needed to produce the desired luminous flux. This in turn can reduce the cost on complexity of the lamps. These LED packages can comprise LEDs encapsulated with a material that can withstand the elevated luminous flux or can comprise unencapsulated LEDs.

In some embodiments the light source can comprise one or more blue emitting LEDs and the phosphor layer in the phosphor carrier can comprise one or more materials that absorb a portion of the blue light and emit one or more different peak wavelengths of light such that the lamp emits a white light combination from the blue LED and the conversion material. The conversion material can absorb the blue LED light and emit different peak wavelengths of light including but not limited to red, yellow and green. The light source can also comprise different LEDs and conversion materials emitting different colors of light so that the lamp emits light with the desired characteristics such as color temperature and color rendering.

The separation of the phosphor elements from the LEDs provides that added advantage of easier and more consistent color binning. This can be achieved in a number of ways. LEDs from various bins (e.g. blue LEDs from various bins) can be assembled together to achieve substantially wavelength uniform excitation sources that can be used in different lamps. These can then be combined with phosphor carriers having substantially the same conversion characteristics to provide lamps emitting light within the desired bin. In addition, numerous phosphor carriers can be manufactured and pre-binned according to their different conversion characteristics. Different phosphor carriers can be combined with light sources emitting different characteristics to provide a lamp emitting light within a target color bin.

Furthermore, the phosphor carriers in the different lamps according to the present invention can be arranged with multiple phosphors. In some embodiments, they can comprise yellow/green and red phosphors, that can give the phosphor carrier and orange appearance. The lamps can comprise blue emitting LEDs, with the yellow/green and red lighting components provided by the phosphors and the lamp emitting a white light combination of blue, yellow/green or red.

In other embodiments multiple peak emissions (lighting components) can be provided by the LEDs with one or more peak emission also being provided by the phosphor absorbing one or more of the peak emissions from the LEDs and re-emitting one or more peak emissions from the the phosphor carrier. In some embodiments, the red lighting component can be provided by one or more red emitting LEDs instead of from a red phosphor. The red emitting LEDs can comprise LEDs made from a material system that provides red emission from the active region, and the red LEDs can be in an array with the blue LEDs. This arrangement can reduce the cost associated with providing the typically more expensive red phosphors in a phosphor carrier.

The present invention is described herein with reference to certain embodiments, but it is understood that the invention can be embodied in many different forms and should not be construed as limited to the embodiments set forth herein. In particular, the present invention is described below in regards to certain lamps having one or multiple LEDs or LED chips or LED packages in different configurations, but it is understood that the present invention can be used for many other lamps having many different configurations. Examples of different lamps arranged in different ways according to the present invention are described below and in U.S. Provisional Patent application Ser. No. 61/435,759, to Le et al., entitled "Solid State Lamp", filed on Jan. 24, 2011, and incorporated herein by reference.

The embodiments below are described with reference to LED of LEDs, but it is understood that this is meant to encompass LED chips and LED packages. The components can have different shapes and sizes beyond those shown and different numbers of LEDs can be included. It is also understood that the embodiments described below are utilize co-planar light sources, but it is understood that non co-planar light sources can also be used. It is also understood that the lamp's LED light source may be comprised of one or multiple LEDs, and in embodiments with more than one LED, the LEDs may have different emission wavelengths. Similarly, some LEDs may have adjacent or contacting phosphor layers or regions, while others may have either adjacent phosphor layers of different composition or no phosphor layer at all.

The present invention is described herein with reference to conversion materials, phosphor layers and phosphor carriers and diffusers being remote to one another. Remote in this context refers being spaced apart from and/or to not being on or in direct thermal contact.

It is also understood that when an element such as a layer, region or substrate is referred to as being "on" another element, it can be directly on the other element or intervening elements may also be present. Furthermore, relative terms such as "inner", "outer", "upper", "above", "lower", "beneath", and "below", and similar terms, may be used herein to describe a relationship of one layer or another region. It is understood that these terms are intended to encompass different orientations of the device in addition to the orientation depicted in the figures.

Although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Embodiments of the invention are described herein with reference to cross-sectional view illustrations that are schematic illustrations of embodiments of the invention. As such, the actual thickness of the layers can be different, and variations from the shapes of the illustrations as a result, for example, of manufacturing techniques and/or tolerances are expected. Embodiments of the invention should not be construed as limited to the particular shapes of the regions illustrated herein but are to include deviations in shapes that result, for example, from manufacturing. A region illustrated or described as square or rectangular will typically have rounded or curved features due to normal manufacturing tolerances.

Thus, the regions illustrated in the figures are schematic in nature and their shapes are not intended to illustrate the precise shape of a region of a device and are not intended to limit the scope of the invention.

FIG. 4 shows one embodiment of a lamp 50 according to the present invention that comprises a heat sink structure 52 having an optical cavity 54 with a platform 56 for holding a light source 58. Although this embodiment and some embodiments below are described with reference to an optical cavity, it is understood that many other embodiments can be provided without optical cavities. These can include, but are not limited to, light sources being on a planar surface of the lamp structure or on a pedestal. The light source 58 can comprise many different emitters with the embodiment shown comprising an LED. Many different commercially available LED chips or LED packages can be used including but not limited to those commercially available from Cree, Inc. located in Durham, N.C. It is understood that lamp embodiments can be provided without an optical cavity, with the LEDs mounted in different ways in these other embodiments. By way of example, the light source can be mounted to a planar surface in the lamp or a pedestal can be provided for holding the LEDs.

The light source 58 can be mounted to the platform using many different known mounting methods and materials with light from the light source 58 emitting out the top opening of the cavity 54. In some embodiments light source 58 can be mounted directly to the platform 56, while in other embodiments the light source can be included on a submount or printed circuit board (PCB) that is then mounted to the platform 56. The platform 56 and the heat sink structure 52 can comprise electrically conductive paths for applying an electrical signal to the light source 58, with some of the conductive paths being conductive traces or wires. Portions of the platform 56 can also be made of a thermally conductive material and in some embodiments heat generated during operation can spread to the platform and then to the heat sink structure.

The heat sink structure 52 can at least partially comprise a thermally conductive material, and many different thermally conductive materials can be used including different metals such as copper or aluminum, or metal alloys. Copper can have a thermal conductivity of up to 400 W/m-k or more. In some embodiments the heat sink can comprise high purity aluminum that can have a thermal conductivity at room temperature of approximately 210 W/m-k. In other embodiments the heat sink structure can comprise die cast aluminum having a thermal conductivity of approximately 200 W/m-k. The heat sink structure 52 can also comprise other heat dissipation features such as heat fins 60 that increase the surface area of the heat sink to facilitate more efficient dissipation into the ambient. In some embodiments, the heat fins 60 can be made of material with higher thermal conductivity than the remainder of the heat sink. In the embodiment shown the fins 60 are shown in a generally horizontal orientation, but it is understood that in other embodiments the fins can have a vertical or angled orientation. In still other embodiments, the heat sink can comprise active cooling elements, such as fans, to lower the convective thermal resistance within the lamp. In some embodiments, heat dissipation from the phosphor carrier is achieved through a combination of convection thermal dissipation and conduction through the heat sink structure 52. Different heat dissipation arrangements and structures are described in U.S. Provisional Patent Application Ser. No. 61/339,516, to Tong et al., entitled "LED Lamp Incorporating Remote Phosphor With Heat Dissipation Feature," also assigned to Cree, Inc. application and is incorporated herein by reference.

Reflective layers 53 can also be included on the heat sink structure 52, such as on the surface of the optical cavity 54. In those embodiments not having an optical cavity the reflective layers can be included around the light source. In some embodiments the surfaces can be coated with a material having a reflectivity of approximately 75% or more to the lamp visible wavelengths of light emitted by the light source 58 and/or wavelength conversion material ("the lamp light"), while in other embodiments the material can have a reflectivity of approximately 85% or more to the lamp light. In still other embodiments the material can have a reflectivity to the lamp light of approximately 95% or more.

The heat sink structure 52 can also comprise features for connecting to a source of electricity such as to different electrical receptacles. In some embodiments the heat sink structure can comprise a feature of the type to fit in conventional electrical receptacles. For example, it can include a feature for mounting to a standard Edison socket, which can comprise a screw-threaded portion which can be screwed into an Edison socket. In other embodiments, it can include a standard plug and the electrical receptacle can be a standard outlet, or can comprise a GU24 base unit, or it can be a clip and the electrical receptacle can be a receptacle which receives and retains the clip (e.g., as used in many fluorescent lights). These are only a few of the options for heat sink structures and receptacles, and other arrangements can also be used that safely deliver electricity from the receptacle to the lamp 50. The lamps according to the present invention can comprise a power supply or power conversion unit that can comprise a driver to allow the bulb to run from an AC line voltage/current and to provide light source dimming capabilities. In some embodiments, the power supply can comprise an offline constant-current LED driver using a non-isolated quasi-resonant flyback topology. The LED driver can fit within the lamp and in some embodiments can comprise a less than 25 cubic centimeter volume, while in other embodiments it can comprise an approximately 20 cubic centimeter volume. In some embodiments the power supply can be non-dimmable but is low cost. It is understood that the power supply used can have different topology or geometry and can be dimmable as well.

A phosphor carrier 62 is included over the top opening of the cavity 54 and a dome shaped diffuser 76 is included over the phosphor carrier 62. In the embodiment shown phosphor carrier covers the entire opening and the cavity opening is shown as circular and the phosphor carrier 62 is a circular disk. It is understood that the cavity opening and the phosphor carrier can be many different shapes and sizes. It is also understood that the phosphor carrier 62 can cover less than all of the cavity opening. As further described below, the diffuser 76 is arranged to disperse the light from the phosphor carrier and/or LED into the desired lamp emission pattern and can comprise many different shapes and sizes depending on the light it receives from and the desired lamp emission pattern.

Embodiments of phosphor carriers according to the present invention can be characterized as comprising a conversion material and thermally conductive light transmitting material, but it is understood that phosphor carriers can also be provided that are not thermally conductive. The light transmitting material can be transparent to the light emitted from the light source 58 and the conversion material should be of the type that absorbs the wavelength of light from the light source and re-emits a different wavelength of light. In the embodiment shown, the thermally conductive light transmitting material comprises a carrier layer 64 and the conversion material comprises a phosphor layer 66 on the phosphor carrier. As further described below, different embodiments can comprise many different arrangements of the thermally conductive light transmitting material and the conversion material.

When light from the light source 58 is absorbed by the phosphor in the phosphor layer 66 it is re-emitted in isotropic directions with approximately 50% of the light emitting forward and 50% emitting backward into the cavity 54. In prior LEDs having conformal phosphor layers, a significant portion of the light emitted backwards can be directed back into the LED and its likelihood of escaping is limited by the extraction efficiency of the LED structure. For some LEDs the extraction efficiency can be approximately 70%, so a percentage of the light directed from the conversion material back into the LED can be lost. In the lamps according to the present invention having the remote phosphor configuration with LEDs on the platform 56 at the bottom of the cavity 54 a higher percentage of the backward phosphor light strikes a surface of the cavity instead of the LED. Coating these surfaces with a reflective layer 53 increases the percentage of light that reflects back into the phosphor layer 66 where it can emit from the lamp. These reflective layers 53 allow for the optical cavity to effectively recycle photons, and increase the emission efficiency of the lamp. It is understood that the reflective layer can comprise many different materials and structures including but not limited to reflective metals or multiple layer reflective structures such as distributed Bragg reflectors. Reflective layers can also be included around the LEDs in those embodiments not having a optical cavity.

The carrier layer 64 can be made of many different materials having a thermal conductivity of 0.5 W/m-k or more, such as quartz, silicon carbide (SiC) (thermal conductivity ~120 W/m-k), glass (thermal conductivity of 1.0-1.4 W/m-k) or sapphire (thermal conductivity of ~40 W/m-k). In other embodiments, the carrier layer 64 can have thermal conductivity greater than 1.0 W/m-k, while in other embodiments it can have thermal conductivity of greater than 5.0 W/m-k. In still other embodiments it can have a thermal conductivity of greater that 10 W/m-k. In some embodiments the carrier layer can have thermal conductivity ranging from 1.4 to 10 W/m-k. The phosphor carrier can also have different thicknesses depending on the material being used, with a suitable range of thicknesses being 0.1 mm to 10 mm or more. It is understood that other thicknesses can also be used depending on the characteristics of the material for the carrier layer. The material should be thick enough to provide sufficient lateral heat spreading for the particular operating conditions. Generally, the higher the thermal conductivity of the material, the thinner the material can be while still providing the necessary thermal dissipation. Different factors can impact which carrier layer material is used including but not limited to cost and transparency to the light source light. Some materials may also be more suitable for larger diameters, such as glass or quartz. These can provide reduced manufacturing costs by formation of the phosphor layer on the larger diameter carrier layers and then singulation into the smaller carrier layers.

Many different phosphors can be used in the phosphor layer 66 with the present invention being particularly adapted to lamps emitting white light. As described above, in some embodiments the light source 58 can be LED based and can emit light in the blue wavelength spectrum. The phosphor layer can absorb some of the blue light and re-emit yellow. This allows the lamp to emit a white light combination of blue and yellow light. In some embodiments, the blue LED light can be converted by a yellow conversion material using a commercially available YAG:Ce phosphor, although a full range of broad yellow spectral emission is possible using conversion particles made of phosphors based on the $(Gd,Y)_3(Al,Ga)_5O_{12}$:Ce system, such as the $Y_3Al_5O_{12}$:Ce (YAG). Other yellow phosphors that can be used for creating white light when used with a blue emitting LED based emitter include but are not limited to:

$Tb_{3-x}RE_xO_{12}$:Ce(TAG); RE=Y, Gd, La, Lu; or $Sr_{2-x-y}Ba_xCa_ySiO_4$:Eu.

The phosphor layer can also be arranged with more than one phosphor either mixed in with the phosphor layer 66 or as a second phosphor layer on the carrier layer 64. In some embodiments, each of the two phosphors can absorb the LED light and can re-emit different colors of light. In these embodiments, the colors from the two phosphor layers can be combined for higher CRI white of different white hue (warm white). This can include light from yellow phosphors above that can be combined with light from red phosphors. Different red phosphors can be used including:

$Sr_xCa_{1-x}S$:Eu, Y; Y=halide;

$CaSiAlN_3$:Eu; or $Sr_{2-y}Ca_ySiO_4$:Eu

Other phosphors can be used to create color emission by converting substantially all light to a particular color. For example, the following phosphors can be used to generate green light:

$SrGa_2S_4$:Eu;

$Sr_{2-y}Ba_ySiO_4$:Eu; or $SrSi_2O_2N_2$:Eu.

The following lists some additional suitable phosphors used as conversion particles phosphor layer 66, although others can be used. Each exhibits excitation in the blue and/or UV emission spectrum, provides a desirable peak emission, has efficient light conversion, and has acceptable Stokes shift:

YELLOW/GREEN $(Sr,Ca,Ba)\ (Al,Ga)_2S_4:Eu^{2+}$ $Ba_2(Mg,Zn)\ Si_2O_7:Eu^{2+}$ $Gd_{0.46}Sr_{0.31}Al_{1.23}O_xF_{1.38}:Eu^{2+}{}_{0.06}$ $(Ba_{1-x-y}Sr_xCa_y)\ SiO_4$:Eu $Ba_2SiO_4:Eu^{2+}$ $Lu_3Al_5O_{12}$ doped with $Ce^{3+}$ $(Ca,Sr,Ba)\ Si_2O_2N_2$ doped with $Eu^{2+}$ CaSc2O4:$Ce^{3+}$ (Sr,Ba) 2SiO4:$Eu^{2+}$

RED $Lu_2O_3:Eu^{3+}$ $(Sr_{2-x}La_x)\ (Ce_{1-x}Eu_x)\ O_4$ $Sr_2Ce_{1-x}Eu_xO_4$ $Sr_{2-x}Eu_xCeO_4$ $SrTiO_3:Pr^{3+},Ga^{3+}$ $CaAlSiN_3:Eu^{2+}$ $Sr_2Si_5N_8:Eu^{2+}$

Different sized phosphor particles can be used including but not limited to particles in the range of 10 nanometers (nm) to 30 micrometers (μm), or larger. Smaller particle sizes typically scatter and mix colors better than larger sized particles to provide a more uniform light. Larger particles are typically more efficient at converting light compared to smaller particles, but emit a less uniform light. In some embodiments, the phosphor can be provided in the phosphor layer 66 in a binder, and the phosphor can also have different concentrations or loading of phosphor materials in the binder. A typical concentration being in a range of 30-70% by weight. In one embodiment, the phosphor concentration is approximately 65% by weight, and is preferably uniformly dispersed throughout the remote phosphor. The phosphor layer 66 can also have different regions with different conversion materials and different concentrations of conversion material.

Different materials can be used for the binder, with materials preferably being robust after curing and substantially transparent in the visible wavelength spectrum. Suitable materials include silicones, epoxies, glass, inorganic glass, dielectrics, BCB, polymides, polymers and hybrids thereof, with the preferred material being silicone because of its high transparency and reliability in high power LEDs. Suitable phenyl- and methyl-based silicones are commercially available from Dow® Chemical. The binder can be cured using many different curing methods depending on different factors such as the type of binder used. Different curing methods include but are not limited to heat, ultraviolet (UV), infrared (IR) or air curing.

Phosphor layer 66 can be applied using different processes including but not limited to spin coating, sputtering, printing, powder coating, electrophoretic deposition (EPD), electrostatic deposition, among others. As mentioned above, the phosphor layer 66 can be applied along with a binder material, but it is understood that a binder is not required. In still other embodiments, the phosphor layer 66 can be separately fabricated and then mounted to the carrier layer 64.

In one embodiment, a phosphor-binder mixture can be sprayed or dispersed over the carrier layer 64 with the binder then being cured to form the phosphor layer 66. In some of these embodiments the phosphor-binder mixture can be sprayed, poured or dispersed onto or over the a heated carrier layer 64 so that when the phosphor binder mixture contacts the carrier layer 64, heat from the carrier layer spreads into and cures the binder. These processes can also include a solvent in the phosphor-binder mixture that can liquefy and lower the viscosity of the mixture making it more compatible with spraying. Many different solvents can be used including but not limited to toluene, benzene, zylene, or OS-20 commercially available from Dow Corning®, and different concentration of the solvent can be used. When the solvent-phosphor-binder mixture is sprayed or dispersed on the heated carrier layer 64 the heat from the carrier layer 64 evaporates the solvent, with the temperature of the carrier layer impacting how quickly the solvent is evaporated. The heat from the carrier layer 64 can also cure the binder in the mixture leaving a fixed phosphor layer on the carrier layer. The carrier layer 64 can be heated to many different temperatures depending on the materials being used and the desired solvent evaporation and binder curing speed. A suitable range of temperature is 90 to 150° C., but it is understood that other temperatures can also be used. Various deposition methods and systems are described in U.S. Patent Application Publication No. 2010/0155763, to Donofrio et al, entitled "Systems and Methods for Application of Optical Materials to Optical Elements," and also assigned to Cree, Inc. This application was filed concurrently with this application and is incorporated herein by reference.

The phosphor layer 66 can have many different thicknesses depending at least partially on the concentration of phosphor material and the desired amount of light to be converted by the phosphor layer 66. Phosphor layers according to the present invention can be applied with concentration levels (phosphor loading) above 30%. Other embodiments can have concentration levels above 50%, while in still others the concentration level can be above 60%. In some embodiments the phosphor layer can have thicknesses in the range of 10-100 microns, while in other embodiments it can have thicknesses in the range of 40-50 microns.

The methods described above can be used to apply multiple layers of the same of different phosphor materials and different phosphor materials can be applied in different areas of the carrier layer using known masking processes. The methods described above provide some thickness control for the phosphor layer 66, but for even greater thickness control the phosphor layer can be ground using known methods to reduce the thickness of the phosphor layer 66 or to even out the thickness over the entire layer. This grinding feature provides the added advantage of being able to produce lamps emitting within a single bin on the CIE chromaticity graph. Binning is generally known in the art and is intended to ensure that the LEDs or lamps provided to the end customer emit light within an acceptable color range. The LEDs or lamps can be tested and sorted by color or brightness into different bins, generally referred to in the art as binning. Each bin typically contains LEDs or lamps from one color and brightness group and is typically identified by a bin code. White emitting LEDs or lamps can be sorted by chromaticity (color) and luminous flux (brightness). The thickness control of the phosphor layer provides greater control in producing lamps that emit light within a target bin by controlling the amount of light source light converted by the phosphor layer. Multiple phosphor carriers 62 with the same thickness of phosphor layer 66 can be provided. By using a light source 58 with substantially the same emission characteristics, lamps can be manufactured having nearly the same emission characteristics that in some instances can fall within a single bin. In some embodiments, the lamp emissions fall within a standard deviation from a point on a CIE diagram, and in some embodiments the standard deviation comprises less than a 10-step McAdams ellipse. In some embodiments the emission of the lamps falls within a 4-step McAdams ellipse centered at CIExy(0.313, 0.323).

The phosphor carrier 62 can be mounted and bonded over the opening in the cavity 54 using different known methods or materials such as thermally conductive bonding materials or a thermal grease. Conventional thermally conductive grease can contain ceramic materials such as beryllium oxide and aluminum nitride or metal particles such colloidal silver. In other embodiments the phosphor carrier can be mounted over the opening using thermal conductive devices such as clamping mechanisms, screws, or thermal adhesive hold phosphor carrier 62 tightly to the heat sink structure to maximize thermal conductivity. In one embodiment a thermal grease layer is used having a thickness of approximately 100 μm and thermal conductivity of k=0.2 W/m-k. This arrangement provides an efficient thermally conductive path for dissipating heat from the phosphor layer 66. As mentioned above, different lamp embodiments can be provided without cavity and the phosphor carrier can be mounted in many different ways beyond over an opening to the cavity.

During operation of the lamp 50, phosphor conversion heating is concentrated in the phosphor layer 66, such as in the center of the phosphor layer 66 where the majority of LED light strikes and passes through the phosphor carrier 62. The thermally conductive properties of the carrier layer 64 spreads this heat laterally toward the edges of the phosphor carrier 62 as shown by first heat flow 70. There the heat passes through the thermal grease layer and into the heat sink structure 52 as shown by second heat flow 72 where it can efficiently dissipate into the ambient.

As discussed above, in the lamp 50 the platform 56 and the heat sink structure 52 can be thermally connected or coupled. This coupled arrangement results in the phosphor carrier 62 and that light source 58 at least partially sharing a thermally conductive path for dissipating heat. Heat passing through the platform 56 from the light source 58 as shown by third heat flow 74 can also spread to the heat sink structure 52. Heat from the phosphor carrier 62 flowing into the heat sink structure 52 can also flow into the platform 56. As further described below, in other embodiments, the phosphor carrier 62 and the light source 58 can have separate thermally conductive paths for dissipating heat, with these separate paths being referred to as "decoupled" as described in U.S. Provisional Patent Application Ser. No. 61/339,516, to Tong et al. incorporated by reference above.

It is understood that the phosphor carriers can be arranged in many different ways beyond the embodiment shown in FIG. 4. The phosphor layer can be on any surface of the carrier layer or can be mixed in with the carrier layer. The phosphor carriers can also comprise scattering layers that can be included on or mixed in with the phosphor layer or carrier layer. It is also understood that the phosphor and scattering layers can cover less than a surface of the carrier layer and in some embodiments the conversion layer and scattering layer can have different concentrations in different areas. It is also understood that the phosphor carrier can have different roughened or shaped surfaces to enhance emission through the phosphor carrier.

As mentioned above, the diffuser is arranged to disperse light from the phosphor carrier and LED into the desired lamp emission pattern, and can have many different shapes and sizes. In some embodiments, the diffuser also can be arranged over the phosphor carrier to mask the phosphor carrier when the lamp is not emitting. The diffuser can have materials to give a substantially white appearance to give the bulb a white appearance when the lamp is not emitting.

Many different diffusers with different shapes and attributes can be used with lamp 50 as well as the lamps described below, such as those described in U.S. Provisional Patent Application No. 61/339,515, titled "LED Lamp With Remote Phosphor and Diffuser Configuration", filed on Mar. 3, 2010, which is incorporated herein by reference. Diffuser can also take different shapes, including but not limited to generally asymmetric "squat" as in U.S. patent application Ser. No. 12/901,405, titled "Non-uniform Diffuser to Scatter Light Into Uniform Emission Pattern," filed on Oct. 8, 2010, incorporated herein by reference The lamps according to the present invention can comprise many different features beyond those described above. Referring again to FIG. 4, in those lamp embodiments having a cavity 54 can be filled with a transparent heat conductive material to further enhance heat dissipation for the lamp. The cavity conductive material could provide a secondary path for dissipating heat from the light source 58. Heat from the light source would still conduct through the platform 56, but could also pass through the cavity material to the heat sink structure 52. This would allow for lower operating temperature for the light source 58, but presents the danger of elevated operating temperature for the phosphor carrier 62. This arrangement can be used in many different embodiments, but is particularly applicable to lamps having higher light source operating temperatures compared to that of the phosphor carrier. This arrangement allows for the heat to be more efficiently spread from the light source in applications where additional heating of the phosphor carrier layer can be tolerated.

As discussed above, different lamp embodiments according to the present invention can be arranged with many different types of light sources. In one embodiment eight LEDs can be used that are connected in series with two wires to a circuit board. The wires can then be connected to the power supply unit described above. In other embodiments, more or less than eight LEDs can be used and as mentioned above, commercially available LEDs from Cree, Inc. can used including eight XLamp® XP-E LEDs or four XLamp® XP-G LEDs. Different single string LED circuits are described in U.S. patent application Ser. No. 12/566,195, to van de Ven et al., entitled "Color Control of Single String Light Emitting Devices Having Single String Color Control, and U.S. patent application Ser. No. 12/704,730 to van de Ven et al., entitled "Solid State Lighting Apparatus with Compensation Bypass Circuits and Methods of Operation Thereof", both of with are incorporated herein by reference.

Figure 5:
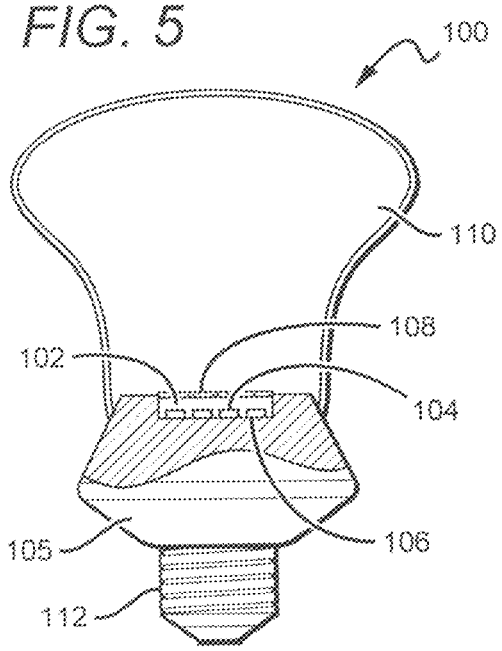
FIG. 5 is a sectional view of one embodiment of a lamp according to the present invention.

FIG. 5 shows still another embodiment of lamp 100 according to the present invention that comprises an optical cavity 102 within a heat sink structure 105. Like the embodiments above, the lamp 100 can also be provided without a lamp cavity, with the LEDs mounted on a surface of the heat sink or on a three dimensional or pedestal structures having different shapes. A planar LED based light source 104 is mounted to the platform 106, and a phosphor carrier 108 is mounted to the top opening of the cavity 102, with the phosphor carrier 108 having any of the features of those described above. In the embodiment shown, the phosphor carrier 108 can be in a flat disk shape and comprises a thermally conductive transparent material and a phosphor layer. It can be mounted to the cavity with a thermally conductive material or device as described above. The cavity 102 can have reflective surfaces to enhance the emission efficiency as described above.

Light from the light source 104 passes through the phosphor carrier 108 where a portion of it is converted to a different wavelength of light by the phosphor in the phosphor carrier 108. In one embodiment the light source 104 can comprise blue emitting LEDs and the phosphor carrier 108 can comprise a yellow phosphor as described above that absorbs a portion of the blue light and re-emits yellow light. The lamp 100 emits a white light combination of LED light and yellow phosphor light. Like above, the light source 104 can also comprise many different LEDs emitting different colors of light and the phosphor carrier can comprise other phosphors to generate light with the desired color temperature and rendering.

The lamp 100 also comprises a shaped diffuser dome 110 mounted over the cavity 102 that includes diffusing or scattering particles such as those listed above. The scattering particles can be provided in a curable binder that is formed in the general shape of dome. In the embodiment shown, the dome 110 is mounted to the heat sink structure 105 and has an enlarged portion at the end opposite the heat sink structure 105. Different binder materials can be used as discussed above such as silicones, epoxies, glass, inorganic glass, dielectrics, BCB, polymides, polymers and hybrids thereof. In some embodiments white scattering particles can be used with the dome having a white color that hides the color of the phosphor in the phosphor carrier 108 in the optical cavity. This gives the overall lamp 100 a white appearance that is generally more visually acceptable or appealing to consumers than the color of the phosphor. In one embodiment the diffuser can include white titanium dioxide particles that can give the diffuser dome 110 its overall white appearance.

The diffuser dome 110 can provide the added advantage of distributing the light emitting from the optical cavity in a more uniform pattern. As discussed above, light from the light source in the optical cavity can be emitted in a generally Lambertian pattern and the shape of the dome 110 along with the scattering properties of the scattering particles causes light to emit from the dome in a more omnidirectional emission pattern. An engineered dome can have scattering particles in different concentrations in different regions or can be shaped to a specific emission pattern. In some embodiments, including those described below, the dome can be engineered so that the emission pattern from the lamp complies with the Department of Energy (DOE) Energy Star defined omnidirectional distribution criteria. One requirement of this standard met by the lamps herein is that the emission uniformity must be within 20% of mean value from 0 to 135° viewing and; >5% of total flux from the lamp must be emitted in the 135-180° emission zone, with the measurements taken at 0, 45, 90° azimuthal angles. As mentioned above, the different lamp embodiments described herein can also comprise A-type retrofit LED bulbs that meet the DOE Energy Star® standards. The present invention provides lamps that are efficient, reliable and cost effective. In some embodiments, the entire lamp can comprise five components that can be quickly and easily assembled.

Like the embodiments above, the lamp 100 can comprise a mounting mechanism 112 of the type to fit in conventional electrical receptacles. In the embodiment shown, the lamp 100 includes a screw-threaded portion 112 for mounting to a standard Edison socket. Like the embodiments above, the lamp 100 can include standard plug and the electrical receptacle can be a standard outlet, or can comprise a GU24 base unit, or it can be a clip and the electrical receptacle can be a receptacle which receives and retains the clip (e.g., as used in many fluorescent lights).

As mentioned above, the space between some of the features of the lamp 100 can be considered mixing chambers, with the space between the light source 104 and the phosphor carrier 108 comprising a first light mixing chamber. The space between the phosphor carrier 108 and the diffuser 110 can comprise a second light mixing chamber, with the mixing chamber promoting uniform color and intensity emission for the lamp. The same can apply to the embodiments below having different shaped phosphor carriers and diffusers. In other embodiments, additional diffusers and/or phosphor carriers can be included forming additional mixing chambers, and the diffusers and/or phosphor carriers can be arranged in different orders.

Figure 6:
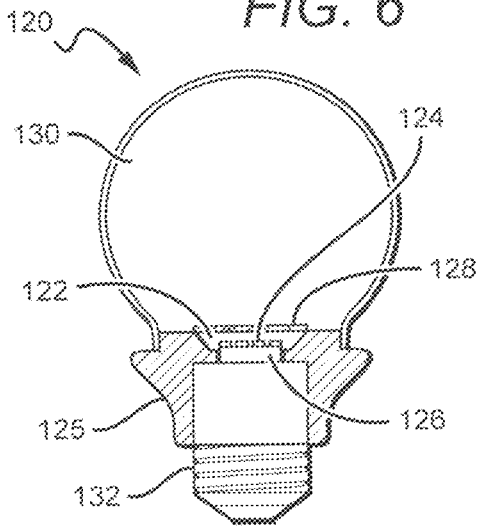
FIG. 6 is a sectional view of one embodiment of a lamp according to the present invention.

Different lamp embodiments according to the present invention can have many different shapes and sizes. FIG. 6 shows another embodiment of a lamp 120 according to the present invention that is similar to the lamp 100 and similarly comprises an optical cavity 122 in a heat sink structure 125 with a light source 124 mounted to the platform 126 in the optical cavity 122. Like above, the heat sink structure need not have an optical cavity, and the light sources can be provided on other structures beyond a heat sink structure. These can include planar surfaces or pedestals having the light source. A phosphor carrier 128 is mounted over the cavity opening with a thermal connection. The lamp 120 also comprises a diffuser dome 130 mounted to the heat sink structure 125, over the optical cavity. The diffuser dome can be made of the same materials as diffuser dome 110 described above, but in this embodiment the dome 130 is oval or egg shaped to provide a different lamp emission pattern while still masking the color from the phosphor in the phosphor carrier 128. It is also noted that the heat sink structure 125 and the platform 126 are thermally de-coupled. That is, there is a space between the platform 126 and the heat sink structure such that they do not share a thermal path for dissipating heat. As mentioned above, this can provide improved heat dissipation from the phosphor carrier compared to lamps not having de-coupled heat paths. The lamp 120 also comprises a screw-threaded portion 132 for mounting to an Edison socket.

In the embodiments above, the phosphor carriers are two dimensional (or flat/planar) with the LEDs in the light source being co-planer. It is understood, however, that in other lamp embodiments the phosphor carriers can take many different shapes including different three-dimensional shapes. The term three-dimensional is meant to mean any shape other than planar as shown in the above embodiments. FIGS. 7 through 10 show different embodiments of three-dimensional phosphor carriers according to the present invention, but it is understood that they can also take many other shapes. As discussed above, when the phosphor absorbs and re-emits light, it is re-emitted in an isotropic fashion, such that the 3-dimensional phosphor carrier serves to convert and also disperse light from the light source. Like the diffusers described above, the different shapes of the 3-dimensional carrier layers can emit light in emission patterns having different characteristics that depends partially on the emission pattern of the light source. The diffuser can then be matched with the emission of the phosphor carrier to provide the desired lamp emission pattern.

FIG. 7 shows a hemispheric shaped phosphor carrier 154 comprising a hemispheric carrier 155 and phosphor layer 156. The hemispheric carrier 155 can be made of the same materials as the carrier layers described above, and the phosphor layer can be made of the same materials as the phosphor layer described above, and scattering particles can be included in the carrier and phosphor layer as described above.

In this embodiment the phosphor layer 156 is shown on the outside surface of the carrier 155 although it is understood that the phosphor layer can be on the carrier's inside layer, mixed in with the carrier, or any combination of the three. In some embodiments, having the phosphor layer on the outside surface may minimize emission losses. When emitter light is absorbed by the phosphor layer 156 it is emitted omnidirectionally and some of the light can emit backwards and be absorbed by the lamp elements such as the LEDs. The phosphor layer 156 can also have an index of refraction that is different from the hemispheric carrier 155 such that light emitting forward from the phosphor layer can be reflected back from the inside surface of the carrier 155. This light can also be lost due to absorption by the lamp elements. With the phosphor layer 156 on the outside surface of the carrier 155, light emitted forward does not need to pass through the carrier 155 and will not be lost to reflection. Light that is emitted back will encounter the top of the carrier where at least some of it will reflect back. This arrangement results in a reduction of light from the phosphor layer 156 that emits back into the carrier where it can be absorbed.

The phosphor layer 156 can be deposited using many of the same methods described above. In some instances the three-dimensional shape of the carrier 155 may require additional steps or other processes to provide the necessary coverage. In the embodiments where a solvent-phosphor-binder mixture is sprayed and the carrier can be heated as described above and multiple spray nozzles may be needed to provide the desired coverage over the carrier, such as approximate uniform coverage. In other embodiments, fewer spray nozzles can be used while spinning the carrier to provide the desired coverage. Like above, the heat from the carrier 155 can evaporate the solvent and helps cure the binder.

In still other embodiments, the phosphor layer can be formed through an emersion process whereby the phosphor layer can be formed on the inside or outside surface of the carrier 155, but is particularly applicable to forming on the inside surface. The carrier 155 can be at least partially filled with, or otherwise brought into contact with, a phosphor mixture that adheres to the surface of the carrier. The mixture can then be drained from the carrier leaving behind a layer of the phosphor mixture on the surface, which can then be cured. In one embodiment, the mixture can comprise polyethylen oxide (PEO) and a phosphor. The carrier can be filled and then drained, leaving behind a layer of the PEO-phosphor mixture, which can then be heat cured. The PEO evaporates or is driven off by the heat leaving behind a phosphor layer. In some embodiments, a binder can be applied to further fix the phosphor layer, while in other embodiments the phosphor can remain without a binder.

Like the processes used to coat the planar carrier layer, these processes can be utilized in three-dimensional carriers to apply multiple phosphor layers that can have the same or different phosphor materials. The phosphor layers can also be applied both on the inside and outside of the carrier, and can have different types having different thickness in different regions of the carrier. In still other embodiments different processes can be used such as coating the carrier with a sheet of phosphor material that can be thermally formed to the carrier.

In lamps utilizing the carrier 155, an emitter can be arranged at the base of the carrier so that light from the emitters emits up and passes through the carrier 155. In some embodiments the emitters can emit light in a generally Lambertian pattern, and the carrier can help disperse the light in a more uniform pattern.

FIG. 8 shows another embodiment of a three dimensional phosphor carrier 157 according to the present invention comprising a bullet-shaped carrier 158 and a phosphor layer 159 on the outside surface of the carrier. The carrier 158 and phosphor layer 159 can be formed of the same materials using the same methods as described above. The different shaped phosphor carrier can be used with a different emitter to provide the overall desired lamp emission pattern. FIG. 9 shows still another embodiment of a three dimensional phosphor carrier 160 according to the present invention comprising a globe-shaped carrier 161 and a phosphor layer 162 on the outside surface of the carrier. The carrier 161 and phosphor layer 162 can be formed of the same materials using the same methods as described above.

FIG. 10 shows still another embodiment phosphor carrier 163 according to the present invention having a generally globe shaped carrier 164 with a narrow neck portion 165. Like the embodiments above, the phosphor carrier 164 includes a phosphor layer 166 on the outside surface of the carrier 164 made of the same materials and formed using the same methods as those described above. In some embodiments, phosphor carriers having a shape similar to the carrier 164 can be more efficient in converting emitter light and re-emitting light from a Lambertian pattern from the light source, to a more uniform emission pattern.

Figure 13:
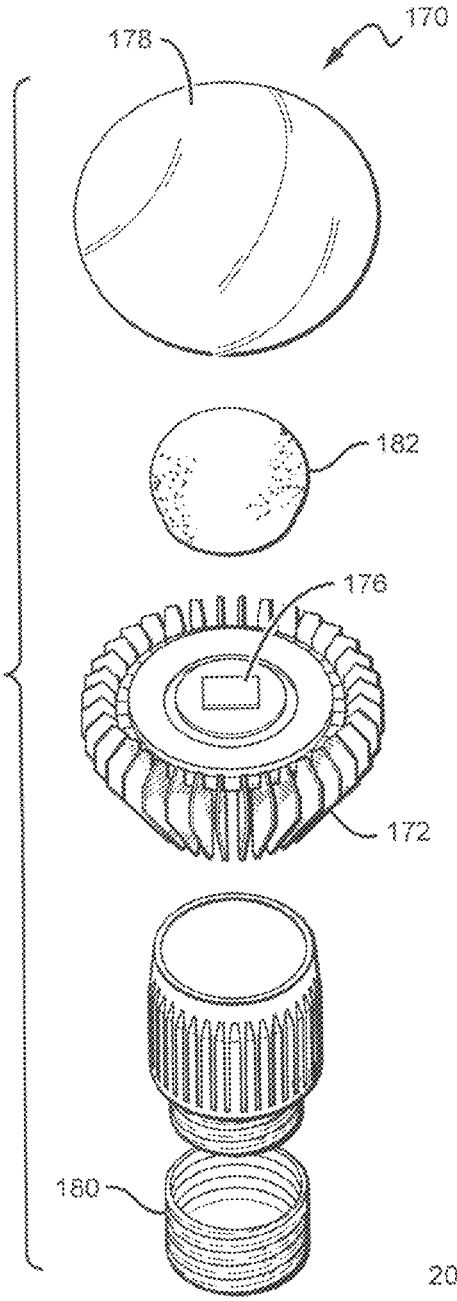
FIG. 13 is an exploded view of the lamp shown in FIG. 11.

FIGS. 11 through 13 show another embodiment of a lamp 170 according to the present invention having a heat sink structure 172, optical cavity 174, light source 176, diffuser dome 178 and a screw-threaded portion 180. This embodiment also comprises a three-dimensional phosphor carrier 182 that includes a thermally conductive transparent material and one phosphor layer. It is also mounted to the heat sink structure 172 with a thermal connection. In this embodiment, however, the phosphor carrier 182 is hemispheric shaped and the emitters are arranged so that light from the light source passes through the phosphor carrier 182 where at least some of it is converted.

The three dimensional shape of the phosphor carrier 182 provides natural separation between it and the light source 176. Accordingly, the light source 176 is not mounted in a recess in the heat sink that forms the optical cavity. Instead, the light source 176 is mounted on the top surface of the heat sink structure 172, with the optical cavity 174 formed by the space between the phosphor carrier 182 and the top of the heat sink structure 172. This arrangement can allow for a less Lambertian emission from the optical cavity 174 because there are no optical cavity side surfaces to block and redirect sideways emission.

In embodiments of the lamp 170 utilizing blue emitting LEDs for the light source 176 and yellow and red phosphor combination in the phosphor carrier. This can cause the phosphor carrier 182 to appear yellow or orange, and the diffuser dome 178 masks this color while dispersing the lamp light into the desired emission pattern. In lamp 170, the conductive paths for the platform and heat sink structure are coupled, but it is understood that in other embodiments they can be decoupled.

Figure 14:
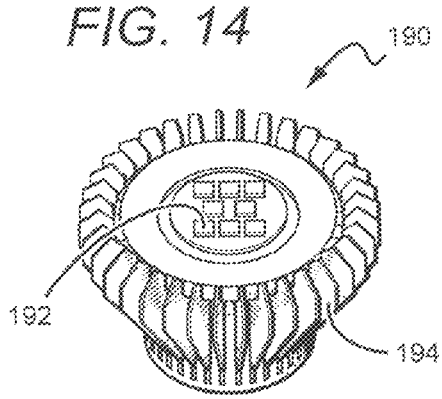
FIG. 14 is a perspective view of one embodiment of a lamp according to the present invention.
Figure 15:
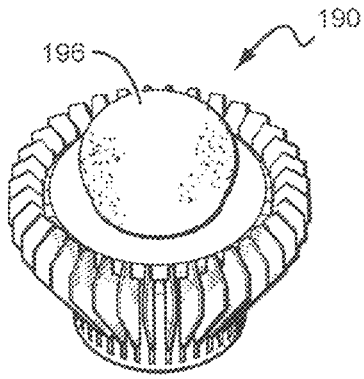
FIG. 15 is a perspective view of the lamp in FIG. 14 with a phosphor carrier.

FIG. 14 shows one embodiment of a lamp 190 according to the present invention comprising an eight LED light source 192 mounted on a heat sink 194 as described above. The emitters can comprise many different types of LEDs that can be coupled together in many different ways and in the embodiment shown are serially connected. In other embodiments, the LEDs can be interconnected in different series and parallel interconnect combinations. It is noted that in this embodiment the emitters are not mounted in a optical cavity, but are instead mounted on top planar surface of the heat sink 194. FIG. 15 shows the lamp 190 shown in FIG. 14 with a dome-shaped phosphor carrier 196 mounted over the light source 192 shown in FIG. 14. The lamp 190 shown in FIG. 15 can be combined with the diffuser 198 as described above to form a lamp with dispersed light emission.

As described in more detail below, the LED lamps according to the present invention can emit the desired combination of light from different elements, with some embodiments combining 3 or more peak emissions (i.e. lighting components). In different embodiments these different peak emissions can come from different lamp features, such as the conversion material or the solid state light source. The combination of these peak emissions can provide light with the desired color, color temperature and/or color rendering. In some embodiments the lamps emit a white light with the desired color temperature and color rendering.

In some embodiments, a lighting unit or lamp according to the principles of the present invention emits light in at least three peak wavelengths, e.g., blue, yellow and red. At least a first wavelength is emitted by the solid state light source, such as blue light, and at least a second wavelength is emitted by the wavelength conversion element, e.g., green and/or yellow light. Depending on the embodiment, the third wavelength of light, such as green and/or red light can be emitted by the solid state light source and/or the wavelength conversion element. In some embodiments, the at least three peak wavelengths can be emitted by the wavelength conversion element or the solid state light source. In some embodiments, the solid state light source can emit overlapping, similar or the same wavelengths of light as the wavelength conversion material. For example, the solid state light source can comprise LEDs that emit a wavelength of light, e.g. red light, that overlaps or is substantially the same as light emitted by phosphors in the wavelength conversion material, e.g., red phosphor added to a yellow phosphor in the wavelength conversion material.

In some embodiments, the solid state light source comprises at least one additional LED that emits light having at least one different peak wavelength of light, and/or the wavelength conversion material comprises at least one additional phosphor or lumiphor emitting at least one different peak wavelength. Accordingly, the lighting unit emits light having at least four different peak wavelengths of light.

As mentioned above, the phosphor carriers can comprise multiple conversion materials, such as yellow/green and red phosphors. These phosphors can provide the yellow/green light components for the white light lamp emission. In different embodiments, however, these light components can be provided directly from LED chips instead of through phosphor conversion. These different arrangements can provide certain advantages, including but not limited to lamps that require lower operating power and can be less expensive by eliminating the need for certain phosphors.

Figure 16:
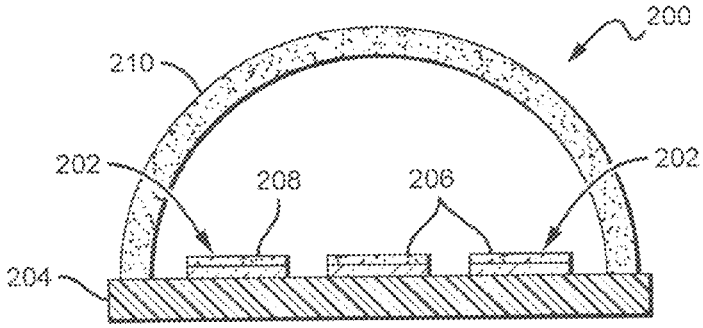
FIG. 16 is a sectional view of one embodiment of a lamp according to the present invention.

FIG. 16 shows one embodiment of a lamp 200 according to the present invention where the red light component can be provided by red LEDs instead of from a red phosphor. The lamp 200 comprising a plurality of LED chips 202 mounted onto a carrier 204 that can comprise a printed circuit board (PCB) carrier, substrate or submount. The carrier 204 can comprise interconnecting electrical traces (not shown) for applying an electrical signal to the LED chips 202. LEDs chips 202 can comprise one or more blue emitting LEDs 206 and one or more red emitting LEDs 208. It is understood that in other embodiments, different commercially available LEDs can be utilized emitting many different colors of light.

A phosphor 210 is included over and spaced apart from the LED chips 202, so that at least some of the light from the LED chips 202 passes through the second phosphor 210. The phosphor 210 should be of the type that absorbs the wavelength of light from the blue LED 206 and re-emits a different wavelength of light. In the embodiments shown, the phosphor 210 is in a dome shape over the LED chips 202, but it is understood that the phosphor 210 can take many different shapes and sizes as described above, such as disks or globes. The phosphor 210 can be in the form of a phosphor carrier characterized as comprising a conversion material in a binder as described above, but can also comprise a carrier that is thermally conductive and a light transmitting material. Phosphors arranged with thermally conductive materials are described in U.S. Provisional Patent Application No. 61/339,516, filed on Mar. 3, 2010 and titled "LED Lamp Incorporating Remote Phosphor With Heat Dissipation Features", which is incorporated herein by reference.

In other embodiments, an encapsulant can be formed or mounted over the LED chips 202 and the second phosphor 210 can be formed or deposited as a layer on the top surface of the encapsulant. The encapsulant can take many different shapes, and in the embodiment shown is dome-shaped. In still other embodiments having an encapsulant, the second phosphor 210 can be formed within the encapsulant as a layer, or in regions of the encapsulant.

Many different phosphors can be used in different embodiments according to the present invention with the phosphor 210 in the embodiment shown comprising a phosphor that absorbs blue light from the LED chips and emits yellow light. Many different phosphors can be used for the yellow conversion material including those described above. During operation, the blue and red light from the LED chips 202 pass through the phosphor 210 where a portion of the blue light is converted to yellow. The red light from the red LED chips can pass through the phosphor 210 without being converted or absorbed. A portion of the blue light can also pass through the phosphor 210 along with the red light from the LED chips 202. As a result, the lamp 200 can emit light that is a combination of blue, red and yellow light, with some embodiments emitting a warm white light combination with the desired color temperature.

Many different blue emitting LEDs can be used that can be made from many different materials, with the suitable blue emitting LEDs being made from the Group-III nitride material system. Many different red emitting LEDs can also be used that can be made from many different materials, such as those made from the AlInGaP material system. These are only examples of the many different materials that can be used for these LEDs.

The use of a red emitting LEDs instead of a red phosphor for red light component can provide certain advantages. The red light emitted directly from the active layer of a red LED has a much narrower peak emission compared to a red phosphor, with the human eye being more responsive to the red light with a narrower peak. In some embodiments, the peak can be less, and the spectrum can have full width at half maximum (FWHM) of less than 50 nanometers (nm) and in other embodiments can have a FWHM of less than 30 nm. By comparison the FWHM peak of red light from a phosphor can be 15 m nm or more.

In addition, red light emitted directly from the LED does not need to be converted and does not suffer the efficiency losses that come from phosphor conversion. As a result, the amount of power needed to produce the overall white emission from the lamp 200 can be reduced up to 25% or more, such that a lamp that would otherwise operate with input power of 12.5 to 13 W can operate with an input power of 10 W. In other embodiments the power reduction can be more than 25%, while in other embodiments it can be less than 20%. This arrangement can provide the additional advantage of reduced cost for the lamps, by eliminating the need for relatively expensive red phosphors. Red phosphors can also be relatively expensive, and using red LEDs for the red emission component can result in a lamp that is less expensive than a similar lamp using red phosphors.

FIG. 17 shows another embodiment of a lamp 220 that is similar to the lamp 200 in FIG. 14, and has many of the same features. It comprises LED chips 222 mounted on a carrier 224, with the LED chips comprising one or more blue emitting LEDs 226 and one or more red emitting LEDs 228 like the ones described in FIG. 14. In this embodiment, the phosphor comprises a green phosphor 230 in a dome over the LEDs 222, with light from the LEDs passing through the phosphor 230. The phosphor absorbs at least some of the light from the blue LEDs 226 and re-emits green light, with the lamp 220 emitting a white light combination or blue, red and green light.

As mentioned above, the lamps and their phosphors can be arranged in many different ways according to the present invention. FIG. 18 shows still another embodiment of a lamp 250 having its LED chips 252 mounted within an optical cavity 254. Like the embodiments above, the LED chips 252 can comprise blue emitting LEDs 256 and red emitting LEDs 258. The LED chips 252 can be mounted to a carrier 260 similar to the carriers described above, and in the embodiment shown the LED chips 252 and the carrier 260 can be mounted within the optical cavity 254. In other embodiments an optical cavity can be mounted to the carrier around the LED chips. The carrier 260 can have a reflective layer 262 on its exposed surface between the LED chips 252 as described above, and the optical cavity 254 can have reflective surfaces 264 to redirect light out the top opening of the optical cavity 254.

As phosphor 266 is arranged over the opening of the optical cavity 254, and in the embodiment shown is in a planar shape. It is understood, however, that the phosphor 266 can take many different shapes, including but not limited to a dome or a globe. Similar to the embodiments above, the phosphor 266 can comprise a phosphor that absorbs light from the LED chips 252 and emits a different color of light. In the embodiment shown, the phosphor 266 comprises one of the yellow phosphors described above that absorbs blue light and re-emits yellow light. Like the embodiments above, blue and red light from the LED chips 252 passes through the phosphor 266 where at least some of the blue light is absorbed by the yellow phosphor and re-emitted as yellow light. The red light from the LED chips can pass through the yellow phosphor while experiencing little or no absorption. The lamp 250 can emit a white light combination of blue, red and yellow light. In other embodiments, the phosphor 266 can comprise one of the green phosphors described above. By providing the red lighting component directly from red emitting LEDs, the lamp 250 can comprise the advantages described above.

FIG. 19 shows another embodiment of an lamp 320 according to the present invention, wherein LED chips 322 are mounted to a carrier 324 with the LED chips 322 comprising one or more blue emitting LEDs and one or more red emitting LEDs. A second yellow (or green) phosphor 330 is arranged in globe over the optical cavity. LED light passes through the phosphor 330 with at least some being converted so that the lamp 320 emits a white light combination of blue, red and green light.

Figure 20:
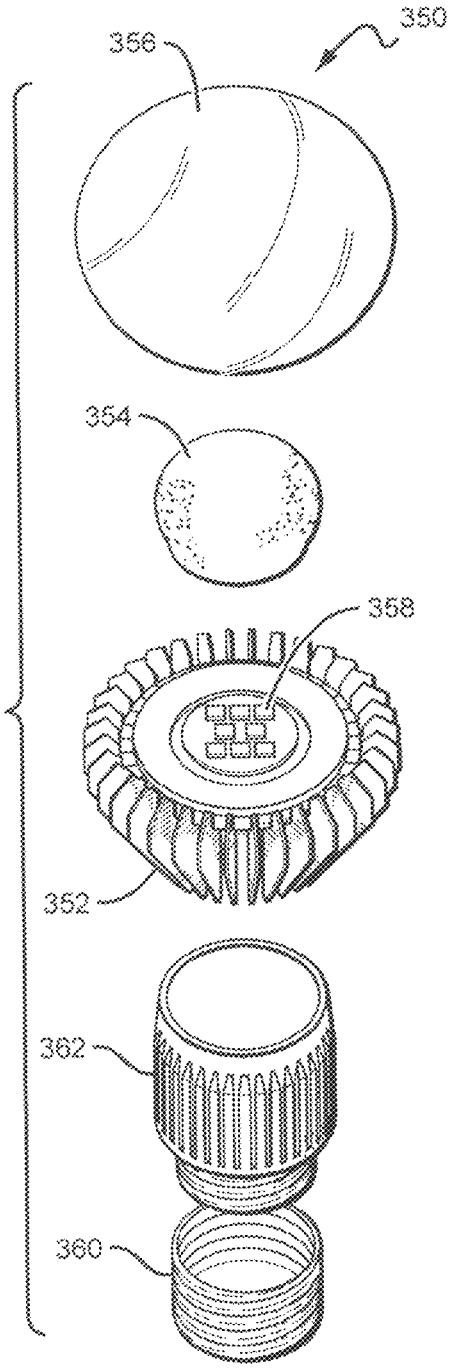
FIG. 20 is exploded view of one embodiment of a lamp according to the present invention.
Figure 21:
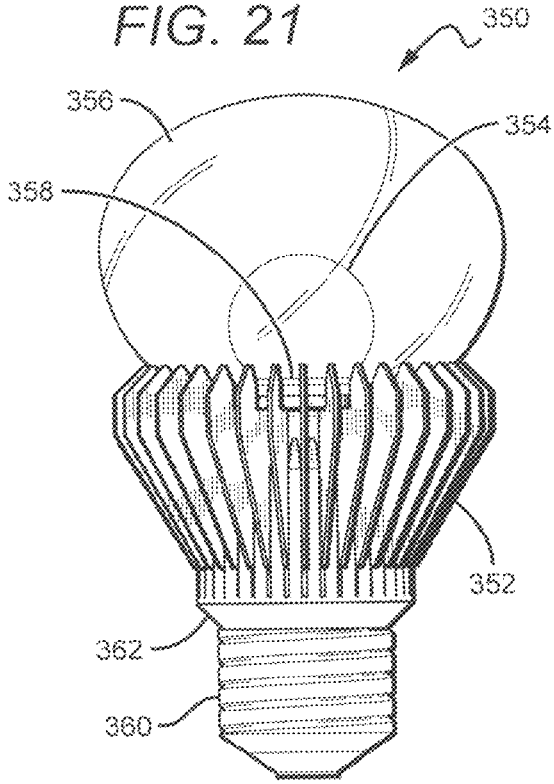
FIG. 21 is sectional view of the lamp shown in FIG. 20.

FIGS. 20 and 21 show another embodiment of a lamp 350 according to the present invention similar to those shown and described in U.S. Provisional Patent Application Ser. No. 61/339,515, filed on Mar. 3, 2010, and titled "Lamp With Remote Phosphor and Diffuser Configuration." and U.S. patent application Ser. No. 12/901,405, filed on Oct. 8, 2010, and titled "Non-uniform Diffuser to Scatter Light Into Uniform Emission Pattern," The lamp comprises a submount or heat sink 352, with a dome shaped phosphor carrier 354 and dome shaped diffuser 356. It also comprises LEDs 358 that in this embodiment are mounted on a planar surface of the heat sink 352 with the phosphor carrier and diffuser over the LED chips 358. The LED chips 358 and phosphor carrier 354 can comprise any of the arrangements and characteristics described above, such as some embodiments having a red and blue emitting LED chips. The phosphor carrier can comprise one or more of the phosphor materials described above, but preferably comprises a phosphor that absorbs blue light and emits yellow light so that the lamp emits a white light combination of blue, red and yellow.

The lamp 350 can comprise a mounting mechanism of the type to fit in conventional electrical receptacles. In the embodiment shown, the lamp 350 includes a screw-threaded portion 360 for mounting to a standard Edison socket. Like the embodiments above, the lamp 350 can include a standard plug and the electrical receptacle can be a standard outlet, or can comprise a GU24 base unit, or it can be a clip and the electrical receptacle can be a receptacle which receives and retains the clip (e.g., as used in many fluorescent lights).

Figure 22:
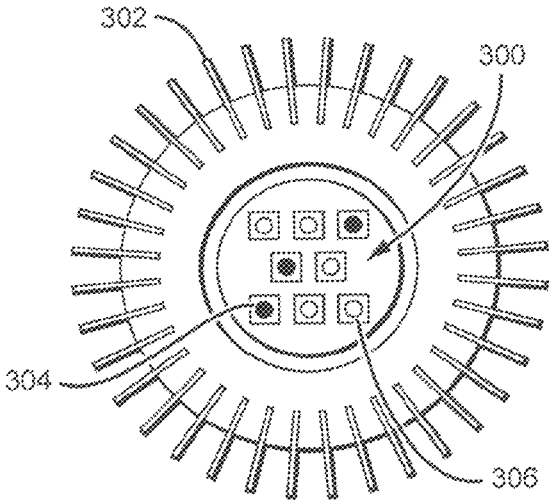
FIG. 22 is a perspective view of one embodiment of a lamp according to the present invention.
Figure 23:
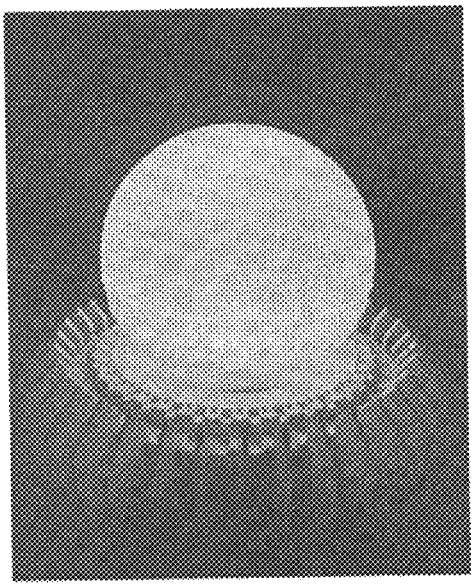
FIGS. 23 through 26 show different phosphors according to the present invention.
Figure 24:
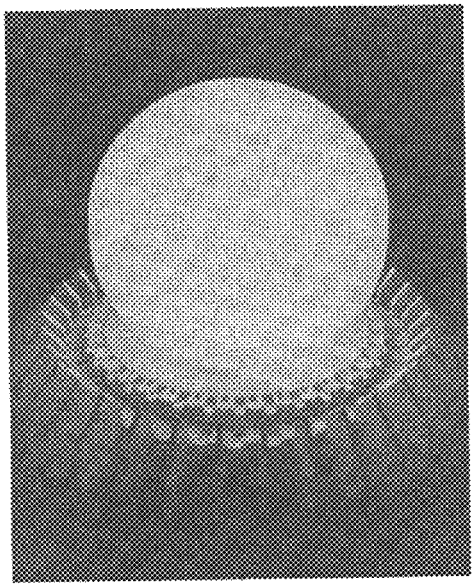
Figure 25:
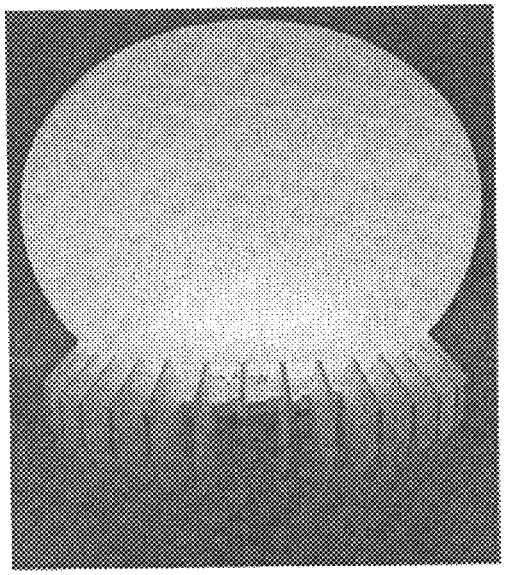
Figure 26:
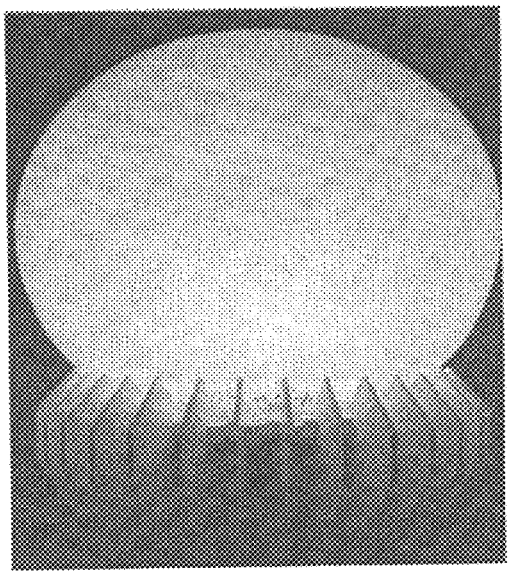
Figures 27, 28:
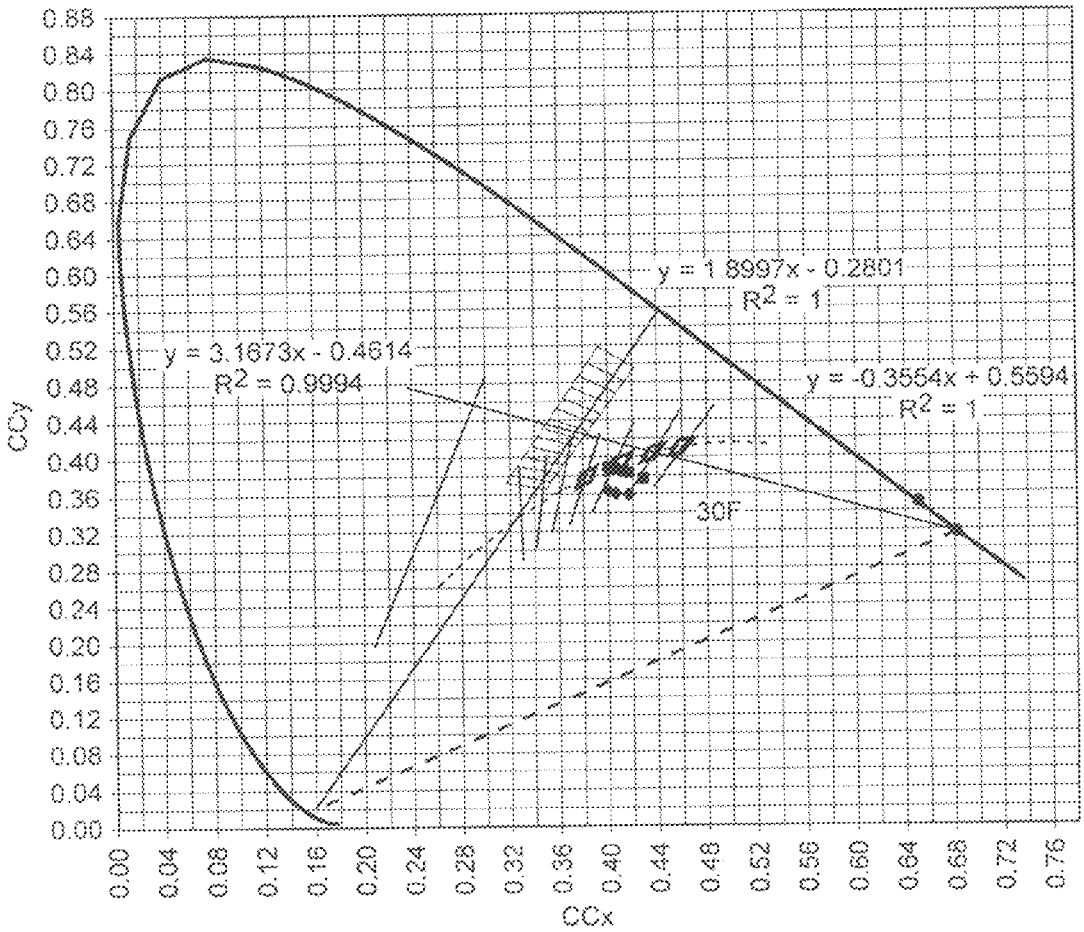
FIG. 27 shows the color targeting for lamps according to the present invention.
FIGS. 28 and 29 show performance characteristics for lamps according to the present invention.

The lamps according to the present invention can comprise a power supply or power conversion unit that can comprise a driver to allow the bulb to run from an AC line voltage/current and to provide light source dimming capabilities. In some embodiments, the power supply can comprise an offline constant-current LED driver using a non-isolated quasi-resonant flyback topology. The LED driver can fit within the lamp 350, such as in body portion 362, and in some embodiments can comprise a less than 25 cubic centimeter volume, while in other embodiments it can comprise an approximately 20 cubic centimeter volume. In some embodiments the power supply can be non-dimmable but is low cost. It is understood that the power supply used can have different topology or geometry and can be dimmable FIG. 22 shows one embodiment of an array of LED chips 300 mounted to a heat sink 302. Different LED arrays can have many different numbers of LEDs and can be arranged in many different ways, with the array shown comprising 3 red emitting LEDs 304 and 5 blue emitting LEDs 306. In other embodiments, the array can comprise 4 red emitting LEDs and 5 blue emitting LEDs. FIGS. 23 through 26 show different embodiments of LED lamps with phosphor globes mounted over the array. These are only a few of the many different shapes and sizes that can be used in the lamps according to the present invention. FIG. 27 shows the color targeting on a CIE diagram for different lamp embodiments according to the present invention.

Figure 29:
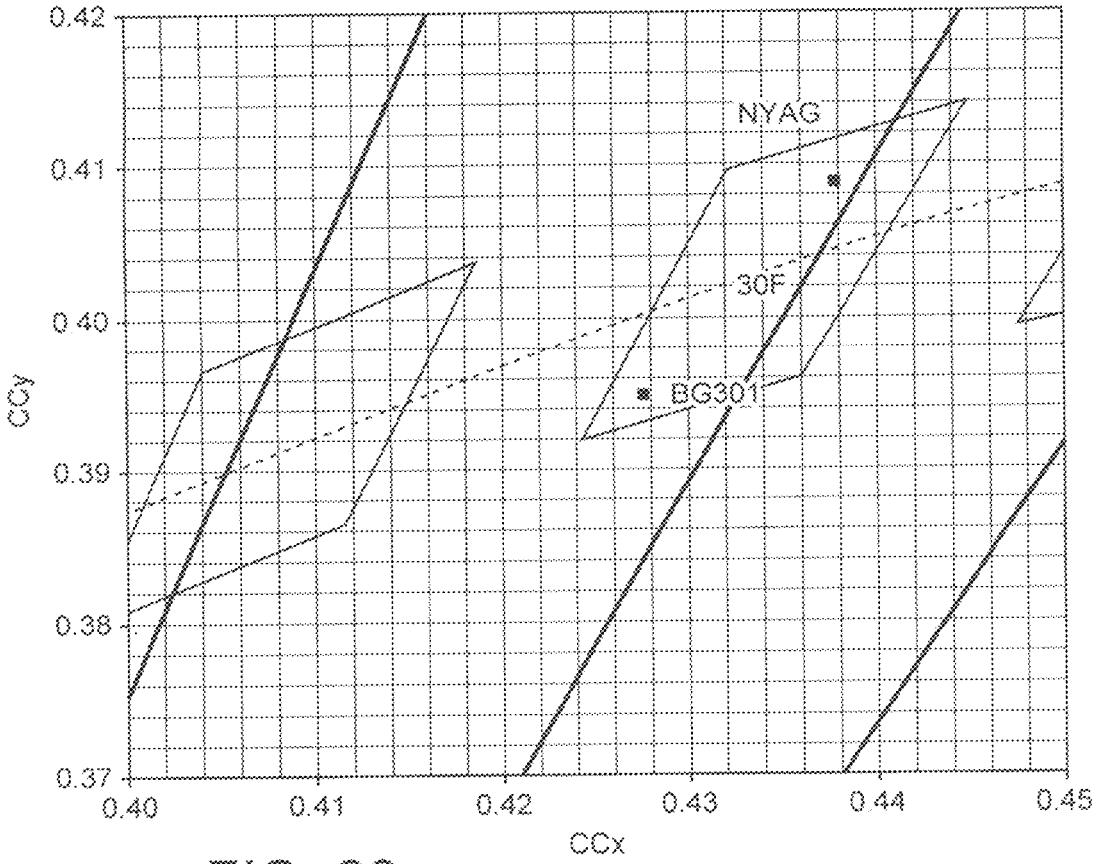

The LED arrays according to the present invention can be coupled together in many different serial and parallel combinations. In one embodiment, the red and blue LEDs can be interconnected in different groups that can comprise their own various series and parallel combinations. By having separate strings, the current applied to each can be controlled to produce the desired lamp color temperature, such as 3000K. FIGS. 28 and 29, show the performance characteristics for an LED array with 3 red and 5 blue (450 nm) LEDs.

Some LED lamps according to the present invention can have a correlated color temperature (CCT) from about 1200K to 3500K, with a color rendering index of 80 or more. Other lamp embodiments can emit light with a luminous intensity distribution that varies by not more than 10% from 0 to 150 degrees from the top of the lamp. In other embodiments, lamps can emit light with a luminous intensity distribution that varies by not more than 20% from 0 to 135 degrees. In some embodiments, at least 5% of the total flux from the lamps is in the 135-180 degree zone. Other embodiments can emit light having a luminous intensity distribution that varies by not more than 30% from 0 to 120 degrees. In some embodiments, the LED lamp has a color spatial uniformity of such that chromaticity with change in viewing angle varies by no more than 0.004 from a weighted average point. Other lamps can conform to the operational requirements for luminous efficacy, color spatial uniformity, light distribution, color rendering index, dimensions and base type for a 60-watt incandescent replacement bulb.

The lamps according to the present invention can emit light with a high color rendering index (CRI), such as or higher in some embodiments. In some other embodiments, the lamps can emit light with CRI of 90 or higher. The lamps can also produce light having a correlated color temperature (CCT) from 2500K to 3500K. In other embodiments, the light can have a CCT from 2700K to 3300K. In still other embodiments, the light can have a CCT from about 2725K to about 3045K. In some embodiments, the light can have a CCT of about 2700K or about 3000K. In still other embodiments, where the light is dimmable, the CCT may be reduced with dimming. In such a case, the CCT may be reduced to as low as 1500K or even 1200K. In some embodiments, the CCT can be increased with dimming. Depending on the embodiment, other output spectral characteristics can be changed based on dimming.

Figure 30:
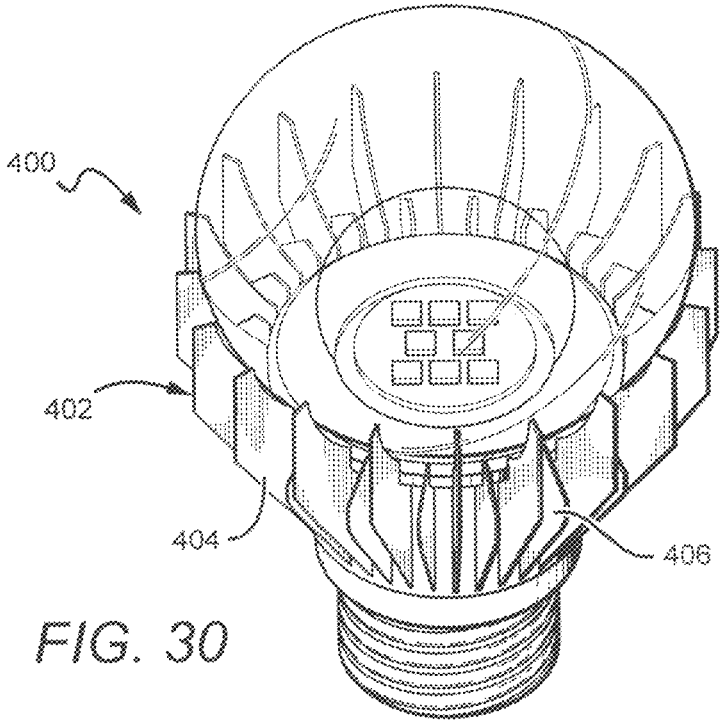
FIG. 30 is a perspective view of one embodiment of a lamp according to the present invention.
Figure 31:
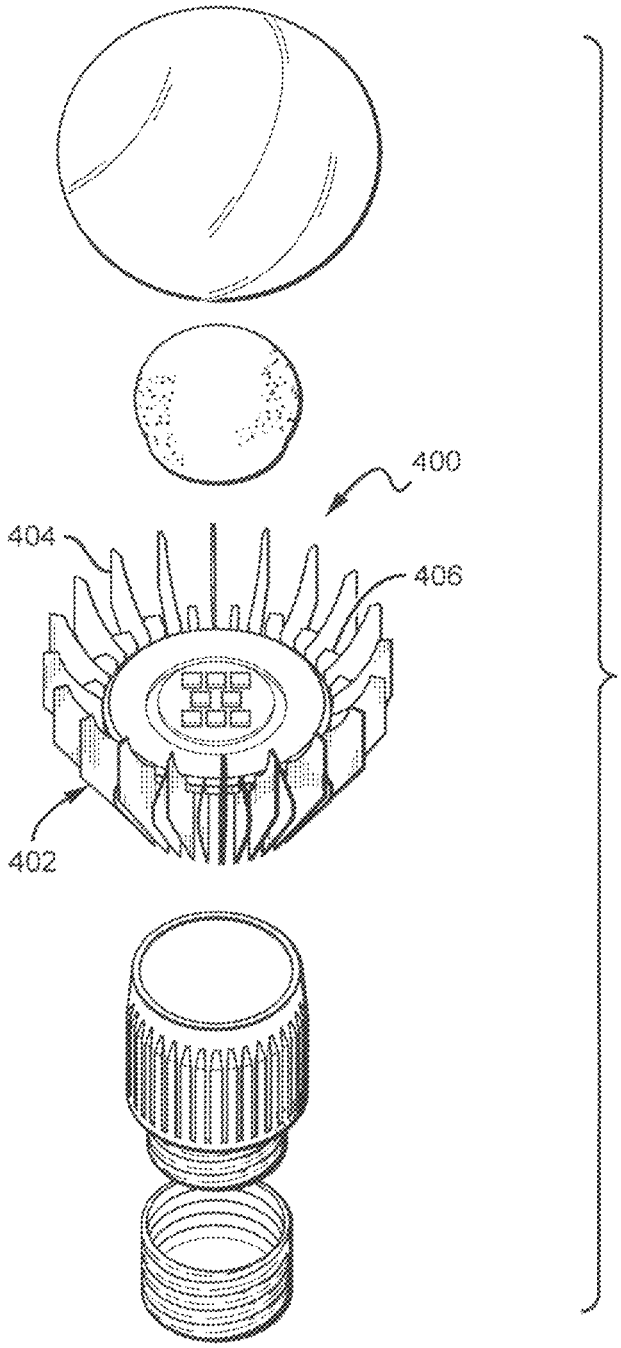
FIG. 31 is an exploded view of the lamp shown in FIG. 30.

FIGS. 30 and 31 show another embodiment of an lamp 400 according to the present invention that is similar to the lamp 350 shown in FIGS. 20 and 21 and described above. The lamp 400 comprising a heat sink 402 having longer fins 404 alternating with shorter fins 406. This arrangement provides the advantage of increased thermal dissipation from the longer heat fins 404, while not excessively blocking downward emitted light by having all fins long. That is, the shorter fins provide a light path opening for downward emitted light, so that the lamp can maintain the desired emission pattern while effectively dissipating heat. It is understood that there can be many different combinations of shorter and longer heat fins according to the present invention, such that there are two or more short heat fins for every long heat fin or vice versa. It is also understood that in other embodiments some of the heat fins can be thicker compared to the others, and that other heat fins can provide combinations of thinner and thicker heat fins with heat fins of different length. In still other embodiments, some of the heat fins can be made of different materials with different heat conduction properties.

The present invention is described in the embodiments above as having red LEDs that provide a lighting component instead of a red phosphor. It is understood that in other embodiments color components can be provided in this same manner.

Although the present invention has been described in detail with reference to certain preferred configurations thereof, other versions are possible. Therefore, the spirit and scope of the invention should not be limited to the versions described above.

We claim:

1. A solid state lamp, comprising:

a first light emitting diode (LED) emitting light at a first peak emission;

a second LED emitting light at a second respective peak emission;

a conversion material spaced from said first and second LEDs with light from said first and second LEDs passing through said conversion material, wherein said conversion material absorbs at least some of said light from said first LED and re-emits light at a third respective peak emission, said lamp emitting a combination of light from said first, second and third peak emissions; and a diffuser over and spaced from said conversion material;

wherein said conversion material is globe-shaped, such that the portion of said globe-shaped conversion material closest to said LEDs is narrower than the widest portion of said globe-shaped conversion material.

2. The lamp of claim 1, wherein said light from said second LED passes through said conversion material without substantial absorption.

3. The lamp of claim 1, wherein light from said first LED comprises blue light.

4. The lamp of claim 1, wherein light from said second LED comprises red light.

5. The lamp of claim 1, wherein said conversion material comprises phosphors.

6. The lamp of claim 1, wherein said conversion material comprises a three-dimensional shape.

7. The lamp of claim 1, wherein said conversion material absorbs light from said first LED and re-emits yellow or green light.

8. The lamp of claim 1, emitting a white light combination of red, blue and yellow or green.

9. The lamp of claim 1, wherein said first and second LEDs comprise a planar LED array.

10. The lamp of claim 1, emitting a white light combination or light from said first and second LEDs, and from said conversion material.

11. The lamp of claim 1, wherein said conversion material emits light at a fourth peak emission, said lamp emitting light with a combination of said peak emissions.

12. The lamp of claim 1, wherein said lamp emits light comprising an emission pattern that is compliant with Energy Star standards.

13. The lamp of claim 1, sized to fit an A19 size profile.

14. The lamp of claim 1, wherein said conversion material is planar.

15. A solid state lamp, comprising:

a heat sink;

an array of light emitting diodes (LEDs) mounted to said heat sink and providing light with first and second respective peak wavelengths, said second peak wavelength being a red wavelength;

a conversion material mounted to said heat sink, said conversion material over and remote to said array of LEDs, with light from said LEDs passing through said conversion material, said conversion material absorbing a portion of one of said first and second peak wavelengths of light and re-emitting a respective third peak wavelength and a respective fourth peak wavelength of light; and a diffuser over and spaced from said conversion material;

said lamp emitting light comprising a combination of said first, second, third, and fourth peak wavelengths;

wherein said conversion material is globe-shaped such that the portion of said globe-shaped conversion material closest to said array of LEDs is narrower than the widest portion of said globe-shaped conversion material.

16. The lamp of claim 15, wherein a portion of the other of said first and second peak wavelengths of light passes through said conversion material without substantial absorption.

17. The lamp of claim 15, wherein said array of LEDs is planar.

18. The lamp of claim 15, wherein said array of LEDs comprises a blue emitting LED.

19. The lamp of claim 15, wherein said array of LEDs comprises a red emitting LED.

20. The lamp of claim 15, wherein said conversion material comprises a phosphor that absorbs blue light and re-emits yellow or green light.

21. The lamp of claim 15, wherein said conversion material comprises a phosphor that does not substantially absorb red light.

22. The lamp of claim 15, wherein said conversion material comprises a dome over said array of LEDs.

23. The lamp of claim 15, further comprising an optical cavity.

24. The lamp of claim 15, emitting a white light combination of light from said array of LEDs and said conversion material.

25. The lamp of claim 15, emitting light with an emission pattern that is Energy Star compliant.

26. The lamp of claim 15, sized to fit an A19 size profile.

27. A solid state lamp, comprising:

a blue emitting light emitting diode (LED);

a red emitting LED;

a phosphor over and spaced from said blue and red LEDs, with light from said blue and red LEDs passing through said phosphor, said phosphor absorbing at least some of said blue LED light and re-emitting a respective different wavelength of light, said lamp emitting a white light combination of red, blue and re-emitted phosphor light; and a diffuser over and spaced from said phosphor;

wherein said phosphor is globe-shaped, such that the portion of said globe-shaped phosphor closest to said LEDs is narrower than the widest portion of said globe-shaped phosphor.

28. The lamp of claim 27, wherein said re-emitted phosphor light comprises yellow or green light.

29. The lamp of claim 27, wherein at least some of said light from said red emitting LED passes through said phosphor without being substantially absorbed.

30. The lamp of claim 27, further comprising an optical cavity.

31. The lamp of claim 27, emitting light with an emission pattern that is Energy Star compliant.

32. The lamp of claim 27, sized to fit an A19 size profile.

33. The lamp of claim 27, emitting light with a color rendering index of 80 or higher.

34. The lamp of claim 27, emitting light comprising a correlated color temperature from approximately 2500K to 3500K.

35. The lamp of claim 27, emitting light comprising a correlated color temperature from approximately 2700K to 3300K.

36. The lamp of claim 27, emitting light comprising a correlated color temperature from approximately 2725K to about 3045K.

37. A solid state lamp, comprising:

an array of light emitting diodes (LEDs) providing light with first and second respective peak wavelengths, said second peak wavelength being a red wavelength;

a conversion means over and remote to said array of LEDs, said conversion means converting light from said first peak wavelength to a respective third peak wavelength; and a diffuser over and spaced from said conversion means;

wherein said conversion means emits light at a fourth peak wavelength;

said lamp emitting a light comprising a white light combination of said first, second, third, and fourth peak wavelengths;

wherein said conversion means is globe-shaped, such that the portion of said globe-shaped conversion means closest to said array of LEDs is narrower than the widest portion of said globe-shaped conversion means.

* * * * *